US006076461A

United States Patent [19]

Takahashi

[11] Patent Number: 6,076,461

[45] Date of Patent: Jun. 20, 2000

[54] STENCIL AND STENCIL PERFORATING DEVICE

[75] Inventor: Mituru Takahashi, Shibata-machi, Japan

[73] Assignee: Tohoku Ricoh Co., Ltd., Shibata-gun, Japan

[21] Appl. No.: 09/184,354

[22] Filed: Nov. 2, 1998

Related U.S. Application Data

[62] Division of application No. 09/028,115, Feb. 23, 1998, Pat. No. 5,927,192, which is a division of application No. 08/809,364, Mar. 28, 1997, Pat. No. 5,799,577.

[30] Foreign Application Priority Data

Jul. 31, 1995 [JP] Japan ..... 7-195309

[51] Int. Cl.[7] ..... B41C 1/14

[52] U.S. Cl. ..... 101/128.4

[58] Field of Search ..... 101/116, 117, 101/118, 121, 122, 128, 21, 128.4, 477, 127, 127.1

[56] References Cited

U.S. PATENT DOCUMENTS

| | | | |
|---|---|---|---|
| 4,628,813 | 12/1986 | Hasegawa et al. | 101/116 |
| 5,207,157 | 5/1993 | Okazaki et al. . | |
| 5,518,328 | 5/1996 | Okuchi et al. . | |
| 5,613,437 | 3/1997 | Motoe et al. | 101/128.4 |
| 5,640,904 | 6/1997 | Sato et al. . | |
| 5,740,731 | 4/1998 | Kagawa | 101/128.4 |
| 5,782,179 | 7/1998 | Kagawa et al. | 101/128.4 |
| 5,816,149 | 10/1998 | Kagawa et al. | 101/128.4 |

FOREIGN PATENT DOCUMENTS

| | | |
|---|---|---|
| 59-16792 | 1/1984 | Japan . |
| 63-178134 | 11/1988 | Japan . |
| 6-239047 | 8/1994 | Japan . |
| 7-17013 | 1/1995 | Japan . |
| 7-101135 | 4/1995 | Japan . |
| 7-125400 | 5/1995 | Japan . |
| 5155169 | 6/1999 | Japan . |
| WO 94/03386 | 2/1994 | WIPO . |

*Primary Examiner*—Ren Yan

*Attorney, Agent, or Firm*—Oblon, Spivak, McClelland, Maier & Neustadt, P.C.

[57] ABSTRACT

A stencil perforating device including a stencil roll holding unit (11) for rotatably holding a stencil roll (16). The stencil roll holding unit has at least one identification mark (11A10, 11A11) which corresponds to at least one identification mark (P1, P2) of the stencil roll (16).

1 Claim, 20 Drawing Sheets

STENCIL AND STENCIL PERFORATING DEVICE

This application is a divisional of application Ser. No. 09/028,115, filed on Feb. 23, 1998, now U.S. Pat. No. 5,927,192, which is a divisional of application Ser. No. 08/809,364, filed on Mar. 28, 1997, now U.S. Pat. No. 5,799,577.

BACKGROUND OF THE INVENTION

This invention relates to an improvement in preventing loosening of a stencil, and more particularly relates to a stencil which is tightly wound in the shape of a roll and is used for a printing machine such as a stencil printer, and to a stencil perforating device which can detect a feeding direction of the stencil roll loaded therein, and automatically or semi-automatically pays the leading edge of the stencil from the stencil roll.

DISCUSSION OF THE BACKGROUND

A stencil printer with a thermosensitive digital stencil perforating capability is extensively used as a simple printer. The stencil printer is operable with a thermosensitive stencil comprising a thermoplastic resin film. In the stencil printer (called "printer" hereinafter), a thermal head selectively perforates the stencil in accordance with image data. After the perforated stencil is wrapped around a print drum, ink is fed from inside the print drum. The ink oozes out to the stencil via a porous wall of the print drum. A sheet is pressed against the surface of the print drum by a press roller or the like via the stencil. Thus, the ink is transferred from the print drum to the sheet via the perforated stencil, thereby forming an image on the sheet.

The thermal head has a number of heating elements arranged in the main scanning direction corresponding to the axial direction of the print drum. The heating elements selectively generate heat under selective control of current supply, thereby perforating corresponding portions of the stencil.

Japanese Utility Model Laid-Open Publication No. Sho 63-178134, for example, teaches a printer having a stencil perforating unit and a document reading unit for reading image data from an original document. The document reading unit is arranged above the stencil perforating unit. With this arrangement, the printer is capable of reading the image data and perforating the stencil as an integral system.

When the stencil in the printer runs out, a fresh stencil roll will be replenished as follows.

First of all, the document reading unit atop the printer is slid away from its regular position, so that the entire stencil perforating unit is visible from above the printer. Usually, a stencil is wound round a core, and is in the shape of a roll in order to save an available space in the printer. The stencil roll is loaded from above the printer into a stencil roll support of the stencil perforating unit.

Subsequently, the leading edge of the stencil is pulled out from the stencil roll, and is then cut to a prescribed length or in a prescribed shape. After the cut piece of the stencil is removed from the printer, the leading edge of the stencil is paid out to a prescribed position. Thereafter, the document reading unit is returned to its regular position.

The foregoing printer has various problems left unsolved as follows. The stencil roll replacing procedure is complicated and troublesome, and requires dexterity on the part of the user, i.e. a full-time operator may be required. In order to replace the stencil roll, the document reading unit must be disposed so as to be movable from its regular position to a standby position. This kind of structure tends to increase necessary mechanical strength and weight of an area for mounting the document reading unit, as well as the number of components. This will increase the cost of machining and assembling of the printer.

Usually, a stencil in the shape of a film strip is wound in the shape of a roll, and is supplied as a stencil roll. The stencil roll pays out the stencil therefrom as it is rotated.

Although the leading edge of the stencil is sandwiched between the thermal head and a platen roller, the stencil roll itself remains rotatable. Whenever it starts or stops rotating, the stencil roll causes inertia moment because of its own weight. Thus, when it starts an operation different from the foregoing one, the stencil roll becomes unstable due to its own weight, which will slacken on the stencil.

In such a case, only the slack portion of the stencil will be paid out as the stencil roll is rotated. Thus, even when the rotation of the stencil roll is precisely controlled, there is a discrepancy between an amount of the stencil actually paid out and a reference amount of the stencil to be paid out in response to the rotation of the stencil roll. This will lead to a problem that the stencil cannot be paid out by the amount necessary for perforation thereof.

Further, the stencil may become slack when the stencil roll is loaded into a stencil roll holding unit. Thus, the stencil may be paid out in a loose state.

Sometimes, the stencil has to be paid out in a predetermined direction depending upon a support structure of the stencil roll holding unit. In such a case, the user should be careful to load the stencil roll correctly, which is rather troublesome.

SUMMARY OF THE INVENTION

In order to overcome the foregoing problems, a first object of the invention is to provide a stencil roll which can keep a stencil from becoming slack when it is handled or carried, or when it is loaded into a stencil roll holder.

A second object of the invention is to provide a stencil which is not slack when it is paid out from a stencil roll.

It is a third object of the invention to provide a stencil perforating device which includes a mechanism for easily detecting a pay-out direction of a stencil when a fresh stencil roll is loaded therein.

It is a final object of the invention to provide a stencil perforating device which can automatically or semi-automatically peel and carry the leading edge of a stencil away from a stencil roll.

According to a first aspect of the invention, there is provided a stencil roll comprising a wound stencil, and having at least one side surface thereof pasted.

In this stencil roll, a side edge of the stencil is bonded on the pasted side surface. The stencil roll can be handled with ease during its carriage, because the stencil is not easily unwound or slackened.

The stencil roll is applicable to a printing operation in which the stencil has its leading edge paid out from the stencil roll, is perforated, is wound round a print drum, is used to print an original image on a sheet using ink, and comprises a thermosensitive material.

During the printing operation, it is possible to prevent the stencil from becoming slack due to inertia force generated by the stencil roll during its rotation. Further, it is possible to prevent the stencil from being unwound when the stencil roll is loaded into a stencil perforating device. Thus, the leading edge of the stencil can be automatically or semi-automatically peeled off from the stencil roll without fail.

The side surface of the stencil roll is pasted with a force that enables the stencil to be peeled off.

The stencil can be peeled and paid out from the stencil roll with a reduced resistance. This enables reduction of an output power necessary for rotating the stencil roll.

The side surface of the stencil roll may be pasted except for a leading edge of the stencil.

The leading edge of the stencil can be easily peeled off from the stencil roll. Further, the stencil can be smoothly brought into contact with a stencil peeler, and peeled off from the stencil roll without becoming slack.

The side surface of the stencil roll may be entirely pasted.

This arrangement protects the stencil against being unwound or becoming slack. This is more advantageous when the stencil roll is applied to the printing operation.

The side surface of the stencil roll may be radially pasted at one portion.

The side surface of the stencil roll may be radially pasted at a plurality of portions.

These stencil rolls are advantageous in that they can be peeled off from the stencil roll with a reduced resistance. Further, it is possible to reduce a force for rotating the stencil roll, and to downsize a member for rotating the stencil roll.

The side surface of the stencil roll may be pasted in the shape of concentric rings having different colors.

A remaining amount of the stencil on the stencil roll can be easily recognized by observing color rings on the side surface of the stencil roll. No special member is necessary for detecting the residual amount of the stencil.

The opposite side surfaces of the stencil roll may be pasted in a manner serving as identification marks.

On the side surfaces of the stencil roll, the identification marks may be colors.

The identification marks may be letters.

The stencil roll having different identification marks on the side surfaces can be reliably set in the stencil perforating device, and this enables the stencil to be correctly orientated on the basis of the identification marks.

Any of the foregoing stencil rolls is applicable to a stencil perforating unit comprising a stencil roll holding unit for rotatably holding the stencil roll, and a member for rotating the stencil roll in the stencil roll holding unit for the purpose of paying a leading edge of the stencil out from the stencil roll.

Any of the foregoing stencil rolls is also applicable to a stencil perforating unit comprising a stencil roll holding unit for rotatably holding the stencil roll, a member for rotating the stencil roll in the stencil roll holding unit, and a peeling member for peeling a leading edge of the stencil. The peeling member is movable toward an outer surface of the stencil roll in accordance with a varying diameter of the stencil roll.

The stencil roll having the identification marks on the side surfaces thereof is applicable to a stencil perforating unit comprising a stencil roll holding unit for rotatably holding the stencil roll. The stencil roll holding unit has identification marks which correspond to the identification marks of the stencil roll, and face with the side surfaces of the stencil roll.

According to a second aspect of the invention there is provided a stencil perforating device which is compatible with any of the foregoing stencil rolls. The stencil perforating device pays a leading edge of the stencil from the stencil roll, and comprises a stencil roll holding unit for rotatably holding the stencil roll, and a member for rotating the stencil roll in the stencil roll holding unit.

The stencil perforating device can peel the leading edge of the stencil semi-automatically.

Another stencil perforating device is compatible with any of the foregoing stencil rolls. The stencil perforating device automatically pays a leading edge of the stencil out from the stencil roll, and comprises a stencil roll holding unit for rotatably holding the stencil roll, a member for rotating the stencil roll in the stencil roll holding unit, and a peeling member for peeling the leading edge of the stencil. The peeling member is movable toward an outer surface of the stencil roll in accordance with a varying diameter of the stencil roll.

A still further stencil perforating device is compatible with the stencil roll having the identification marks on the side surfaces thereof. The stencil perforating device comprises a stencil roll holding unit for rotatably holding the stencil roll. The stencil roll holding unit has identifications marks which correspond to the identification marks of the stencil roll, and face the side surfaces of the stencil roll.

The stencil roll can be reliably and easily loaded into the stencil perforating device in accordance with the identification marks thereon and those of the device.

DESCRIPTION OF THE PREFERRED EMBODIMENTS

The invention will be described with reference to preferred embodiments shown in the accompanying drawings.

Figure 1:
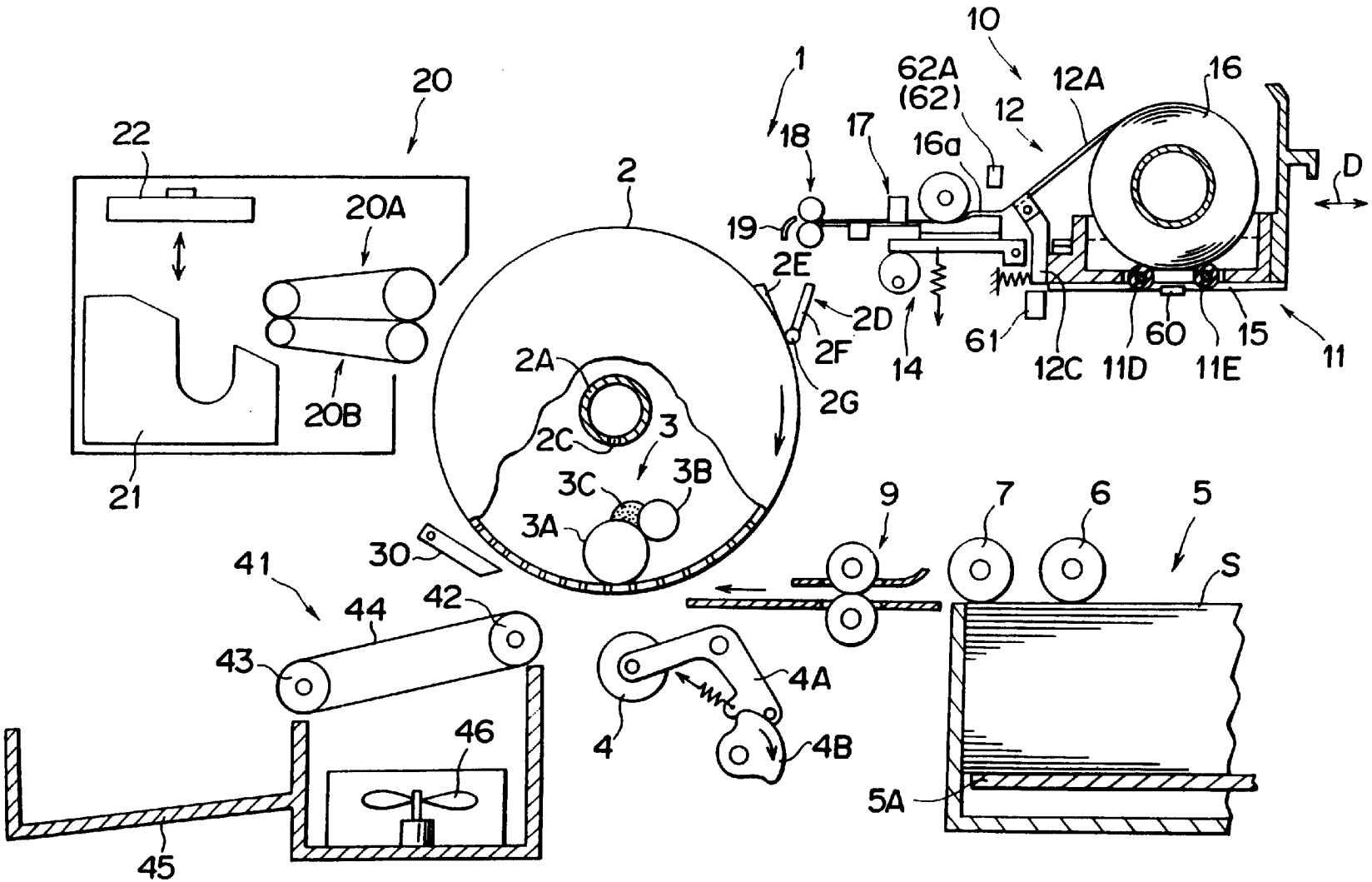
FIG. 1 is a schematic view showing the overall configuration of a stencil printer to which a stencil perforating device according to a first embodiment of the invention is applied.

FIG. 1 schematically shows the configuration of a printing machine for which a stencil roll according to the invention is used. The printing machine is a stencil printer which prints an original image using a perforated stencil. The stencil printer will be described first with respect to its configuration.

Referring to FIG. 1, the stencil printer 1 comprises not only a printing unit including a print drum 2 but also a sheet feeding device 5, a stencil perforating device 10, a used stencil discharging unit 20, and a print discharging unit. The stencil perforating device 10 specifically relates to the invention. The sheet feeding device 5, the used stencil discharging unit 20, and the print discharging unit have well-known structures and configurations.

The print drum 2 is reversibly rotatable about a shaft 2A. Specifically, the print drum 2 is rotated clockwise in order to allow a printing operation, but is rotatable counterclockwise in order to discharge a used stencil.

The print drum 2 has conventional structure and function for wrapping a perforated stencil therearound. The print drum 2 has a porous surface except for a part thereof, and a thin mesh screen (not shown) provided on the porous surface. The mesh screen may be made of synthetic fibers or metal.

A clamp 2D is mounted on the non-porous part of the print drum 2 in order to clamp the leading edge of a stencil. The clamp 2D includes a stage 2E and a clamping member 2F. The stage 2E has a stencil receiving surface extending along a generatrix of the print drum 2. The clamping member 2F angularly turns about a pivot shaft 2G so as to move toward and away from the stage 2E. The stage 2E is made of a magnetic material while the clamping member 2F is made of a rubber magnet. When the stage 2E receives the leading edge of the stencil on its surface, the clamping member 2F moves toward the stage 2E in order to clamp the stencil. The stencil, except for its leading edge, remains stuck to the outer surface of the print drum 2 due to the viscosity of ink which is fed from an ink supply mechanism 3.

The ink supply mechanism 3 is present in the print drum 2, and is positioned substantially under the shaft 2A.

An ink roller 3A and a doctor roller 3B mainly constitute the ink supply mechanism 3.

The ink roller 3A is made of metal, and is located so as to face a press roller 4 (which will be described later) via the print drum 2. The ink roller 3A rotates in contact with the inner surface of the print drum 2 at a peripheral speed synchronous to the peripheral speed of the print drum 2. Ink is deposited on the ink roller 3A in an amount regulated by the doctor roller 3B, and is fed to the pores of the print drum 2 and the mesh screen by the ink roller 3A.

Specifically, ink is dropped via an opening 2C of the shaft 2A to a wedge-shaped ink reservoir 3C formed by the rollers 3A and 3B.

When the press roller 4 is pressed against the print drum 2, the ink roller 3A confronting the press roller 4 protects the print drum 2 against deformation, i.e. the ink roller 3A also functions as a backup roller.

The press roller 4 is located below the ink roller 3A, and faces it via the print drum 2. The press roller 4 is rotatably supported by ends of a pair of swing arms 4A, and is movable to and from the print drum 2. The swing arms 4A are in close contact with the periphery of sector cams 4B via their free ends. The sector cams 4B are rotated by a drive unit (not shown) in synchronization with the feeding of a sheet S from the sheet feeding device 5. When no sheet S is being fed from the sheet feeding device 5, the drive unit causes the sector cams 4B to be in contact with the free ends of the swing arms 4A at their larger diameter portions.

When the sheet S is fed from the sheet feeding device 5, the sector cams 4B rotate until they are in contact with the swing arms 4A via their smaller diameter portions, thereby moving the swing arms 4A upward, in FIG. 1. When the sheet S arrives in the space between the print drum 2 and the press roller 4, the press roller 4 is raised. The sheet S is pressed against the outer surface of the print drum 2. As it is being pressed against the print drum 2 and the perforated stencil, the sheet S receives the ink via the stencil. The position where the press roller 4 is pressed against the print drum 2 defines an image transfer area.

The sheet feeding device 5 is located at the right side of the press roller 4 as shown in FIG. 1, and includes a pick-up roller 6, a separating roller 7, and a pair of register rollers 9, all of which are sequentially arranged along the sheet feeding direction.

The pick-up roller 6 is in contact with each top sheet S on a sheet tray 5A, and feeds it in the sheet feeding direction indicated by an arrow in FIG. 1. The sheet tray 5A is movable, and is always urged to move upwards so as to enable each sheet S to come into contact with the pick-up roller 6. When replenishing sheets, the sheet tray 5A is lowered in order to form a space for receiving them.

The separating roller 7 is in rotatable contact with each top sheet S, similarly to the pick-up roller 6. In order to feed only the top sheet S, a coefficient of friction between the separating roller 7 and the top sheet S is selected to be greater than a coefficient of friction between the sheets S.

The register rollers 9 face each other via a sheet feed path, and periodically move the sheet S toward the foregoing image transfer area.

It is assumed here that the sheet tray 5A is raised until the top sheet S comes into contact with the pick-up roller 6. The pick-up roller 6 is then rotated in response to a signal from a sensor (not shown), thereby feeding the top sheet S in the sheet feeding direction. The separating roller 7 then separates the top sheet S from the underlying sheets S, and feeds it toward the register rollers 9. The sheet S is stopped when it abuts against the register rollers 9 at its leading edge. The register rollers 9 restart feeding the sheet S toward the space between the print drum 2 and the press roller 4 at the same time the press roller 4 is pressed against the print drum 2. In other words, the sheet S is carried to the foregoing space such that its print start position matches with an image formed on the stencil. The image will be printed on the sheet S in a conventional manner.

Referring to FIG. 1, the stencil perforating device 10 according a first embodiment of the invention is located at a right upper side of the print drum 2.

Figure 2:
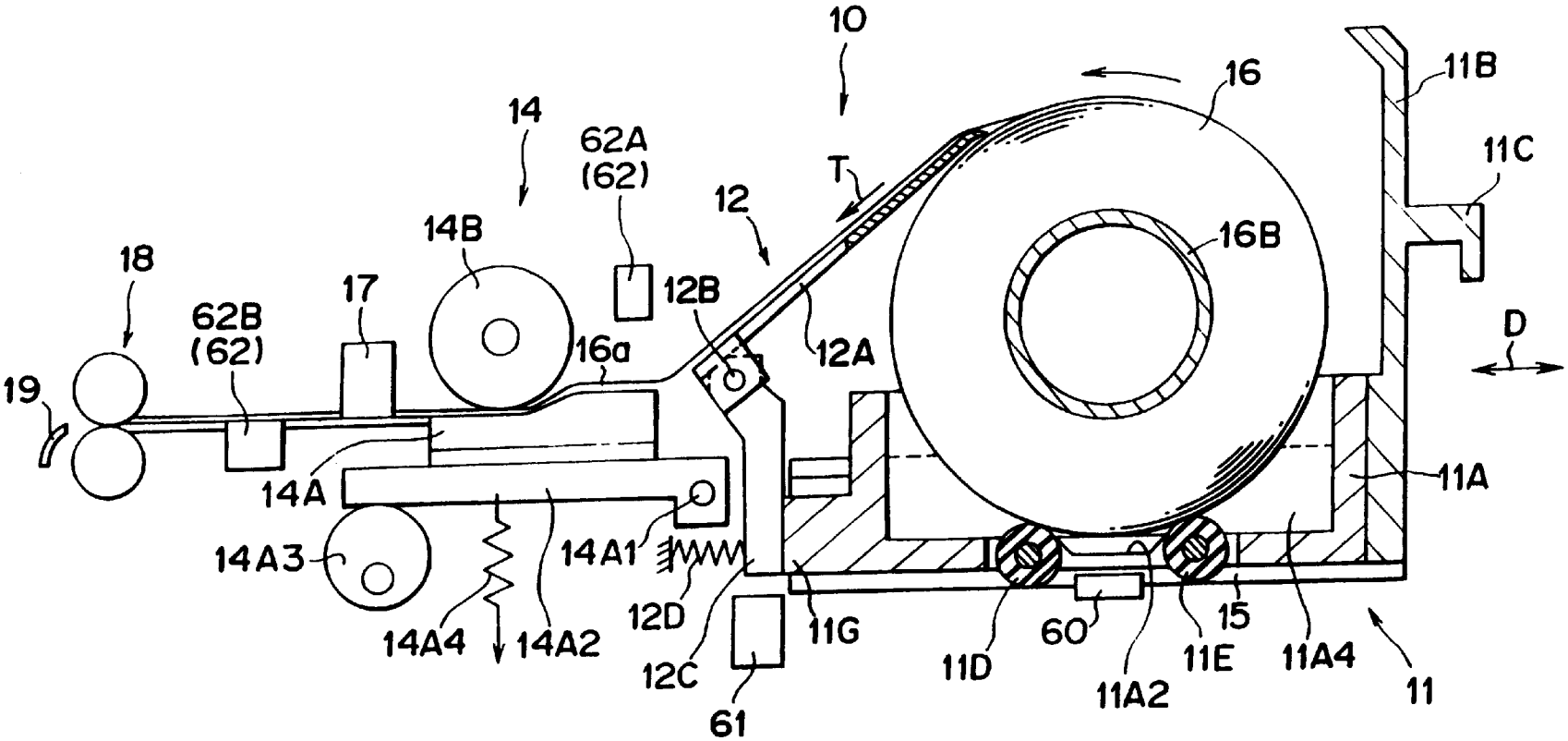
FIG. 2 is a partly enlarged front view of the stencil perforating device shown in FIG. 1.

The stencil is carried to the left from the stencil perforating device 10, as shown in FIGS. 1 and 2. The opposite side edges of the stencil transport path will be sometimes described using modifiers "left" and "right." Further, the upstream side of the stencil transport direction will be sometimes described using a modifier "rear" while the downstream side will be modified by "front."

Figure 3:
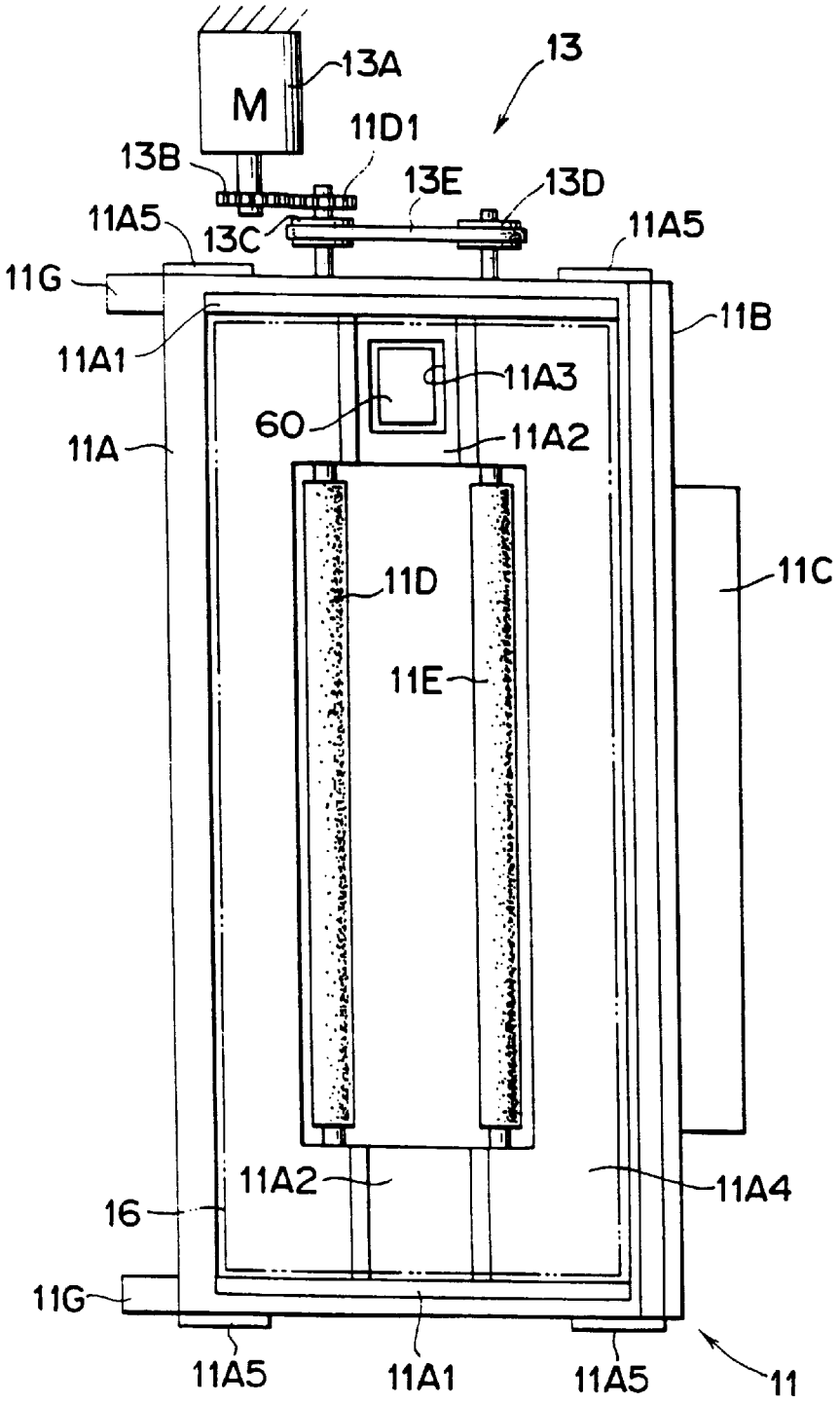
FIG. 3 is a plan view of a stencil roll holding unit in the stencil perforating device of FIG. 1.
Figure 4:
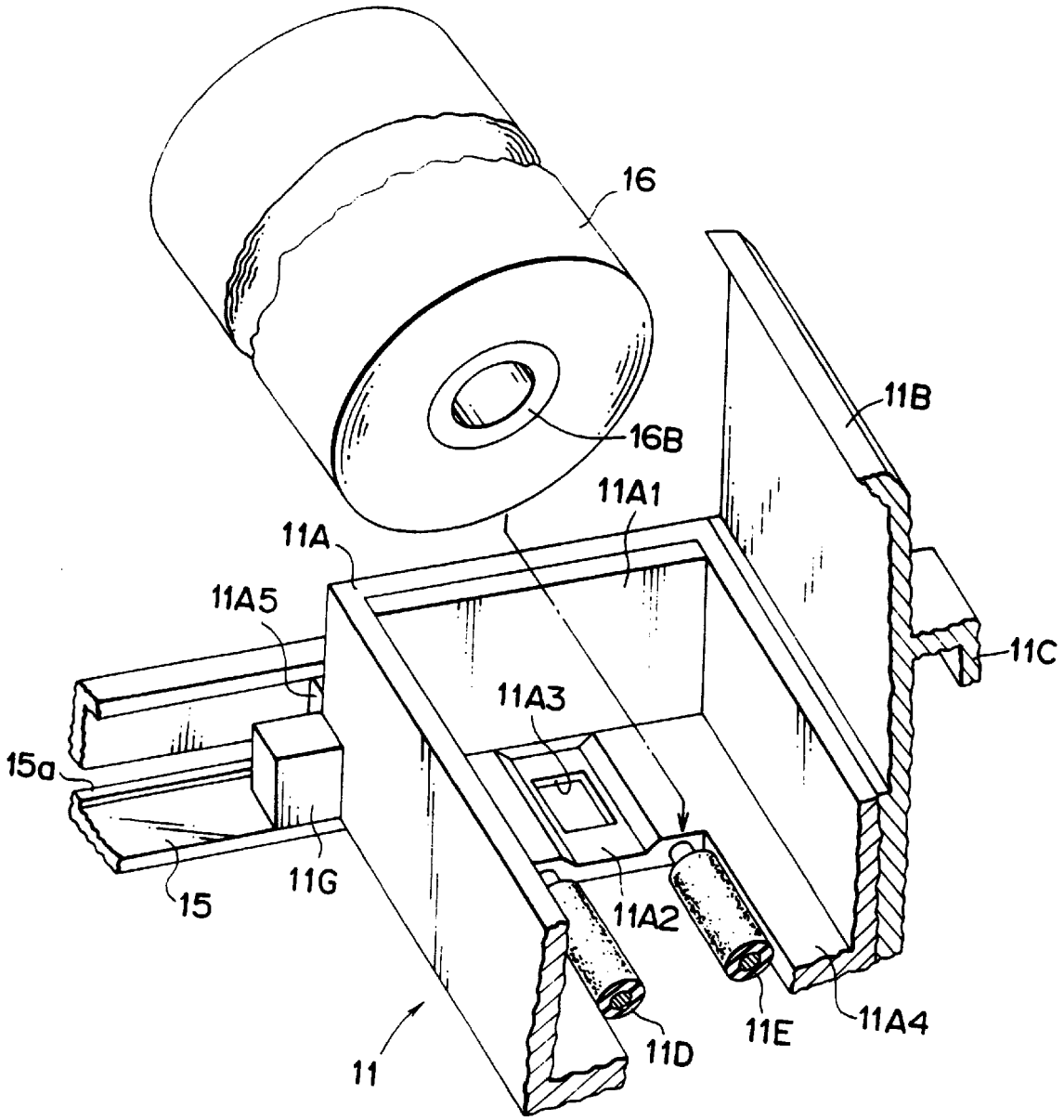
FIG. 4 is a perspective view showing the main part of the stencil roller holding unit of FIG. 3.

As shown in FIGS. 2 to 4, the stencil perforating device 10 mainly comprises a stencil roll holding unit 11, a stencil peeler 12, a stencil roll drive unit 13, and a platen pressure controller 14.

The stencil perforating device 10 automatically peels the leading edge of a stencil 16*a* off from a stencil roll 16 so as to pay it out using the stencil roll drive unit 13 and the stencil peeler 12. The stencil roll holding unit 11 supports the stencil roll 16 such that it is rotatable therein. When the stencil roll 16 is loaded into the stencil roll holding unit 11, the stencil roll drive unit 13 (to be described later) rotates the stencil roll 16. Then, a leading edge of the stencil 16*a* will be peeled by the stencil peeler 12. The stencil peeler 12 is in contact with or near the outer surface of the stencil roll 16 whose diameter varies as the stencil 16*a* is consumed.

The stencil 16*a* is made of a thermoplastic resin film having a light transmission property and being as thin as 1 $\mu$m to 2 $\mu$m, and a porous substrate adhered to the resin film. The porous substrate is implemented by Japanese paper fibers or synthetic fibers, or a combination thereof.

The stencil 16*a* has a laminate structure, and is perforated by heat generated by a thermal head or a similar heating member. The stencil perforating device 10 is preferably compatible with the stencil 16*a* having a thickness between 3 $\mu$m to 60 $\mu$m.

Referring to FIG. 4, the stencil 16*a* is wound round a tubular core 16B, thereby constituting the stencil roll 16.

The tubular core 16B is as long as a width of the stencil 16*a*, i.e. the opposite edges of the core 16B are flush with the opposite side edges of the stencil roll 16.

Conversely, in a conventional stencil roll, a stencil is wound round a core which is longer than the width of the stencil, i.e. the core extends outward from the opposite side edges of the stencil roll.

Any of the stencil rolls to be described with respect to a second embodiment and modifications thereof can be used as the stencil roll 16.

Figure 10:
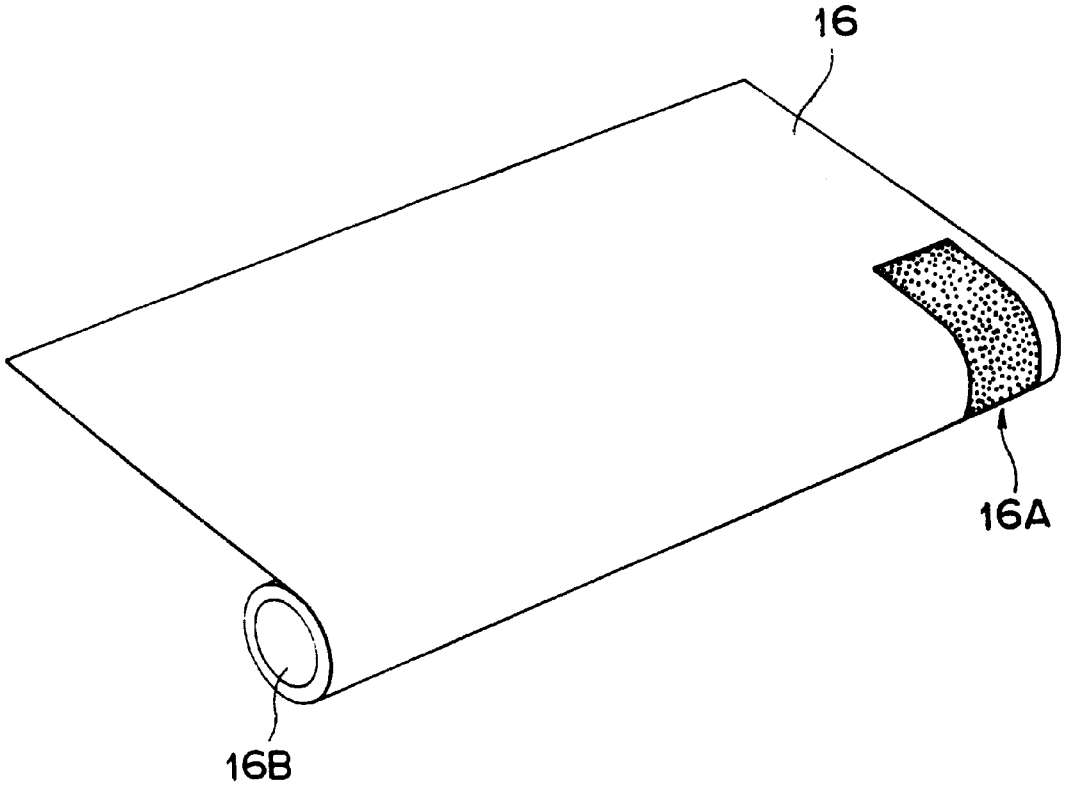
FIG. 10 is a perspective view of a stencil roll used for the stencil perforating device according to the first embodiment.

Referring to FIG. 10, the stencil 16*a* has an end mark 16A which indicates the end of its usable length, and has a low reflectance. The end mark 16A extends to the innermost end of the stencil 16*a*. The end mark 16A may be formed by painting the stencil 16*a* black as will be described later, for example.

The stencil roll 16 is put into a space 11A4 defined by a stencil roll holder 11A in such a manner that the leading edge of the stencil 16*a* can be paid out toward the print drum 2.

The stencil perforating device 10 also includes a pair of right and left guide members 15 which are channel-shaped as shown in FIG. 4. The guide members 15 are disposed with their open sides facing each other, and extend over a predetermined length along the opposite side edges of the stencil transport path. The guide members 15 are respectively attached to right and left side walls (not shown) of the stencil perforating device 10. The right guide member 15 (at the inner part of the plane of the drawing sheet of FIG. 4) has an elongated slot 15*a* at its lower portion. The elongated slot 15*a* extends over a range where the stencil roll holding unit 11 is movable. Stencil roll rotating rollers 11D and 11E (to be described later, and called the "rollers 11D and 11E") have shafts protruding to the right side of the stencil perforating device 10 through the elongated slot 15*a*.

The stencil roll holding unit 11 has a pair of friction members 11A1, a closure member 11B, a handle 11C, push members 11G, and four projections 11A5 as well as the stencil roll holder 11A and the stencil roll rotating rollers 11D and 11E. The stencil roll holder 11A, closure member 11B, handle 11C, push members 11G and projections 11A5 are made of synthetic resin, are suitably reinforced by inserting sheet metal, and are formed as an integral member.

The stencil roll holder 11A is substantially in the shape of a box, and has an open top and openings on its bottom, and enables the stencil roll 16 to be rotatably placed therein. The stencil roll holder 11A receives a lower half of the stencil roll 16 in the space 11A4.

As shown in FIGS. 3 and 4, the projections 11A5 are cubic, are provided on the right and left side walls of the stencil roll holder 11A, and are received in the open sides of the guide members 15. Specifically, two each of cubic projections 11A5 fit in each guide member 15, and are smoothly slidable therein. Thus, stencil roll holder 11A is movable over a predetermined range between the upstream and downstream of the stencil transport path.

The friction members 11*a*1 are provided on the inner surfaces of two facing right and left walls of the stencil roll holder 11A. The friction members 11A1 are positioned so as to be in contact with the opposite side edges of the stencil roll 16 received in the stencil roll holder 11A. The friction members 11A1 may be made of rubber or sponge rubber, for example.

The friction members 11a1 position the stencil roll 16 correctly in the stencil roll holding unit 11. Further, when the stencil roll 16 is rotated in order to pay out the stencil 16a, the friction members 11A1 generate a frictional force which is resistant to the rotation of the stencil roll 16. This force acts on the stencil 16a as back-tension, i.e. it makes the stencil 16a tense, thereby preventing the stencil 16a from becoming slack.

The friction members 11A1 reliably position the stencil roll 16 in the space 11A4 as described above. It is only necessary for the operator to drop the stencil roll 16 into the space 11A4. This eliminates the need for positioning the stencil roll 16 in accordance with the projecting core of the prior art. Thus, the tubular core 16B needs a reduced amount of material and reduced cost.

The closure member 11B is present at the rear part of the stencil roll holder 11A, and constitutes an integral part of an end wall. The closure member 11B includes the handle 11C as its integral member on its outer surface. By holding the handle 11C, the operator can move the stencil roll holder 11A on the guide members 15 in opposite directions as shown by an arrow D in FIG. 2. Specifically, the stencil roll holder 11A is pulled to the right in order to load the stencil roll 16 therein. Then, the stencil roll holder 11A is pushed to the left in order to be returned to its regular position in the stencil perforating device 10.

The push members 11G are positioned at the right and left side edges of the outer wall of the stencil roll holder 11A, opposite to the closure member 11B. The push members 11G are selectively engageable with a peeler support 12C of the stencil peeler 12, which will be described later.

Figure 6:
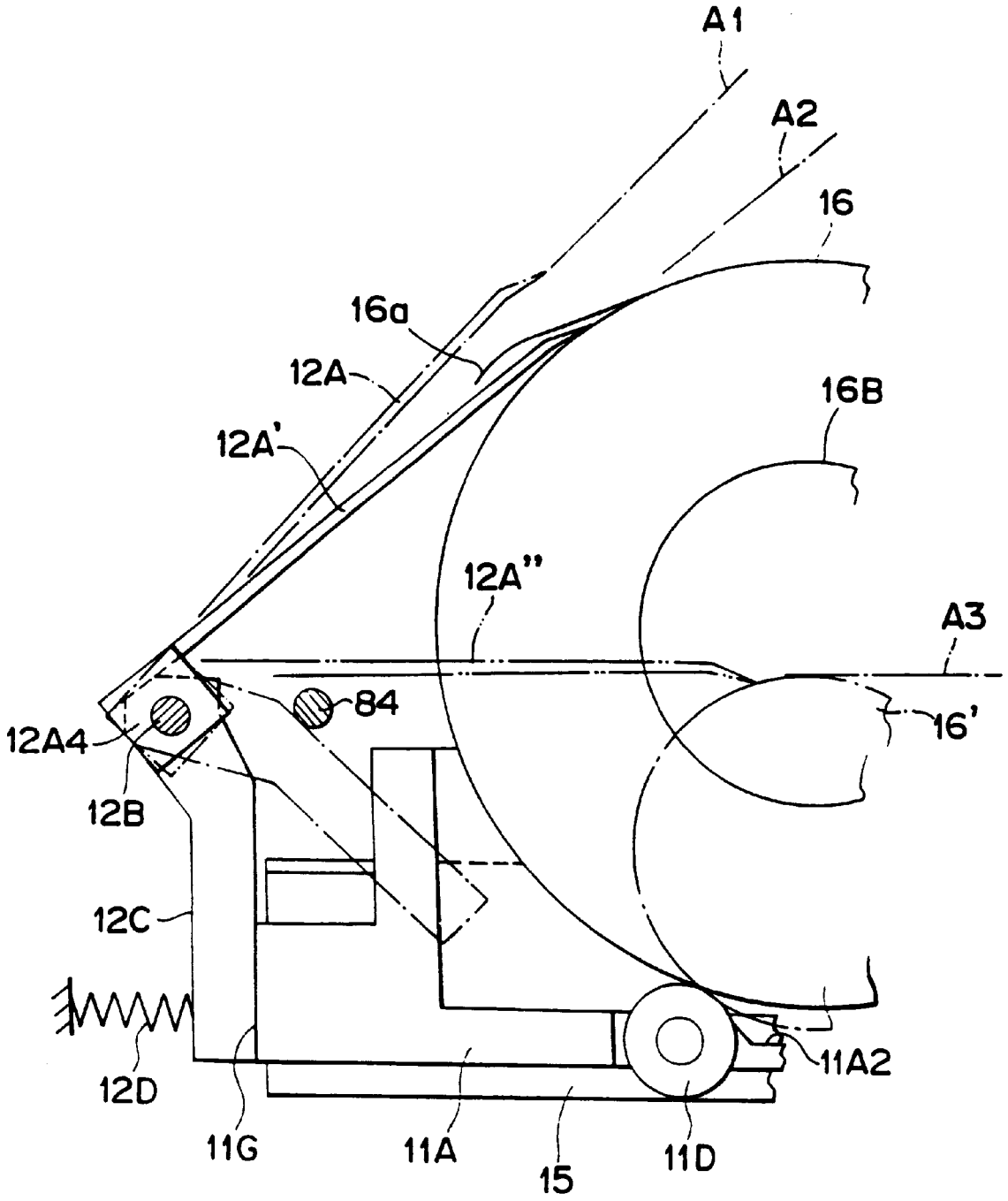
FIG. 6 is a schematic view showing the structure and operation of the main part of the stencil peeler.

Referring to FIGS. 3 and 4, the bottom of the stencil roll holder 11A has a window 11A3 near the right guide member 15. When the stencil roll holder 11A is pushed to its regular position in the stencil perforating device 10, a stencil sensor 60 (to be described later) faces the window 11A3. A pair of recesses 11A2 are formed on the bottom of the stencil roll holder 11A near the opposite side edges of the rollers 11D and 11E, i.e., one is present around the window 11A3, and the other is present at the position opposite to the window 11A3. As the stencil 16a is being paid out, the stencil roll 16 gradually becomes thinner. As shown in FIG. 6, when the stencil roll 16 changes into a stencil roll 16' which is as thin as the core 16B, the recesses 11A2 serve to prevent the stencil roll 16' from coming into direct contact with the bottom of the stencil roll holder 11A.

The detailed configurations of the stencil roll holder 11A and the friction members 11A1 are not shown in the drawing figures. Needless to say, these members are appropriately chamfered, rounded or tapered at portions where they are in direct contact with the stencil roll 16 loaded into the space 11A4, thereby protecting the stencil 16a against damage, scratches and so on.

The stencil roll rotating rollers 11D and 11E are positioned so as to come into contact with the outer surface of the stencil roll 16 in the space 11A4. These rollers 11D and 11E rotate the stencil roll 16 in the direction for paying out the stencil 16a toward the platen pressure controller 14. The rollers 11D and 11E are rotatable via the shafts whose opposite ends are rotatably supported by the bottom of the stencil roll holder 11A. A motor 13A (shown in FIG. 3) constituting a part of the stencil roll drive unit 13 rotates the rollers 11D and 11E, as will be described later.

The rollers 11D and 11E are formed of rubber, sponge rubber or the like, which has a coefficient of friction in a predetermined range, and can rotate the stencil roll 16 in the direction in which the stencil 16a is wound. The rollers 11D and 11E are in contact with the outer surface of the stencil roll 16 so as to rotate it.

The rollers 11D and 11E are juxtaposed with a space kept therebetween and by a prescribed center angle maintained with respect to the axis of the stencil roll 16. Specifically, the rollers 11D and 11E are arranged such that they are in uniform contact with the outer surface of the stencil roll 16 with respect to the axis thereof when the stencil roll 16 becomes as thin as the core 16B and falls into the recesses 11A2 as the stencil 16a is consumed. Further, when the stencil 16a is used up and only the core 16B remains (i.e. the stencil roll 16'), the rollers 11D and 11E support the core 16B such that it is reversibly rotatable.

The stencil roll drive unit 13 is structured so as to rotate the stencil roll 16. As shown in FIG. 3, the stencil roll drive unit 13 mainly comprises a drive gear 13B, a driven gear 11D1, pulleys 13C and 13D, and a belt 13E in addition to the rollers 11D and 11E, and the motor 13A.

The motor 13A is mounted on the right side wall of the stencil perforating device 10, and has the drive gear 13B attached on its output shaft.

In order to pay the stencil 16a out from the stencil roll 16 in the stencil roll holder 11A, the motor 13A is first rotated in the direction opposite to the stencil pay-out direction, and is then rotated in the stencil pay-out direction.

The pulleys 13C and 13D are respectively coupled to the shafts of the rollers 11D and 11E. The belt 13E extends over these pulleys 13C and 13D.

The driven gear 11D1 is supported on the shaft of the roller 11D, and meshes with the drive gear 13B when the stencil roll holder 11A is loaded in its regular position in the stencil perforating device 10. Output torque of the motor 13A is transmitted to the pulley 13D via the drive gear 13B, driven gear 11D1, pulley 13C, and belt 13E. Thus, the rollers 11D and 11E are rotated in the same direction.

Referring to FIG. 2, the stencil peeler 12 is located above the regular position of the stencil roll holder 11A in the stencil perforating device 10.

The stencil peeler 12 mainly includes the foregoing peeler support 12C and a peeling member 12A in the shape of a spatula. The peeling member 12A is usually near or is in contact with the outer surface of the stencil roll 16 which gradually becomes thin, and peels the leading edge of the stencil 16a off from the stencil roll 16.

As shown in FIG. 6, the peeling member 12A swings between a contact position (shown by a solid line and a projection line composed of alternating long dashes and dots) where it comes into contact with the stencil roll 16 and a non-contact position (shown by projection lines) where the peeling member 12A is away from the stencil roll 16. The peeling member 12A is supported, via a shaft 12B, by the peeler support 12C, compression springs 12D, and push members 11G, and swings between the contact and non-contact positions as described above.

The peeling member 12A includes, as integral members, bearings 12A4 at its lower opposite ends as shown in FIGS. 5 to 8. Each bearing 12A4 has a hole 12A3. The shaft 12B passes through the holes 12A3 in order to allow the peeling member 12A to swing between the foregoing two positions.

Both the peeling member 12A and the peeler support 12C have their base ends supported by the shaft 12B. The shaft 12B is fixedly supported at its opposite ends by the right and left side walls of the stencil perforating device 10.

The peeling member 12A is a thin elastic plate made of metal, resin or the like. When it is in contact with the outer surface of the stencil roll 16, the peeling member 12A is elastically deformed so as not to apply an unnecessary load to the stencil 16*a*, and does not damage it.

Figure 5:
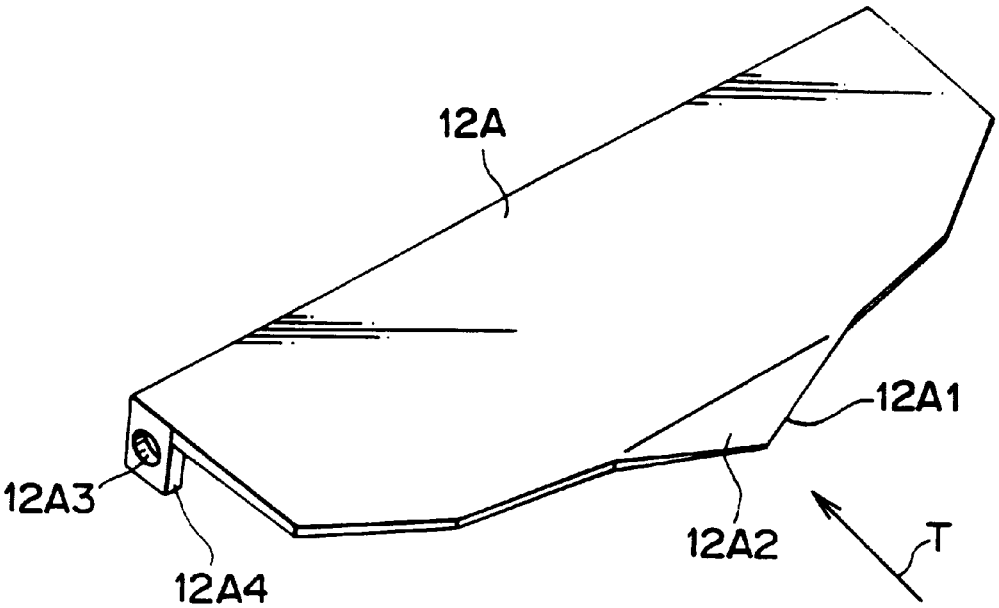
FIG. 5 is a perspective view of an example of a stencil peeler used in the stencil perforating device of FIG. 2.

Referring to FIGS. 5 and 6, the peeling member 12A has a downward projection 12A1 at the center of its front edge. The downward projection 12A1 matches with the center of the leading edge of the stencil 16*a*, and comes close to or into contact with the outer surface of the stencil roll 16 by the weight of the peeling member 12A.

The downward projection 12A1 is formed as thin as possible in relation to the thickness of the stencil 16*a*, and is preferably 3 $\mu$m to 50 $\mu$m thick. The foregoing structure enables the peeling member 12A to peel the center of the leading edge of the stencil 16*a* first of all, and then sequentially peel the other portions of the leading edge toward the opposite side edges of the stencil 16*a* while guiding the peeled portion. This also successfully reduces the resistance applied to the stencil 16*a*. Further, only the downward projection 12A1 may be in contact with the inner surface of the leading edge of the stencil 16*a* separated from the stencil roll 16. This reduces not only the area where the peeling member 12A is in contact with the stencil roll 16 but also the resistance acting on the stencil 16*a*, and enables the leading edge of the stencil 16*a* to be easily picked up from the stencil roll 16.

The compression springs 12D extend between legs of the peeler support 12C and stationary members of the body of the stencil perforating device 10. Thus, the peeling member 12A is usually urged by the compression springs 12D so as to be away from the outer surface of the stencil roll 16. A stop 84 (shown only in FIG. 6) is affixed to the right side wall above the guide member 15. The peeler support 12C is urged to swing toward the stencil roll 16 by the compression springs 12D, and is then stopped by the stop 84 at a position such that the peeler support 12C can be pushed by the push members 11G of the stencil roll holder 11A which is at the regular position.

The stencil peeler 12 operates as follows. When the stencil roll holder 11A is placed at its regular position in the stencil perforating device 10, the push members 11G push the legs of the peeler support 12C. Then, the peeler support 12C moves the peeling member 12A toward the outer surface of the stencil roll 16 against the action of the compression spring 12D. In this state, if it contacts with the outer surface of the stencil roll 16 via its front edge, the peeling member 12A may damage the surface of the stencil 16*a*. In light of this, if the stencil 16*a* is elastic and rigid enough to raise its leading edge by itself, the peeling member 12A may adjoin the outer surface of the stencil roll 16 at a distance which allows it to turn up the leading edge of the stencil 16*a*.

It is assumed that the front edge of the peeling member 12A adjoins the outer surface of the stencil roll 16 at a certain distance as described above. For example, it is possible to maintain the foregoing distance by sensing the varying diameter of the stencil roll 16 using a sensor (not shown), and shifting the front edge of the peeling member 12A in response to the output of the sensor. Conversely, if the stencil 16*a* is not elastic enough to raise its leading edge by itself, the front edge of the peeling member 16A should preferably come into gentle contact with the surface of the stencil 16*a*. This is because the peeling member 12A is configured so as to contact the stencil roll 16 via its front edge by its own weight.

The peeling member 12A also functions as a stencil guide. When the leading edge of the stencil 16*a* is paid out from the stencil roll 16, the stencil 16*a* slides on the upper surface of the peeling member 12A toward the position where a thermal head 14A and a platen roller 14B face each other.

When the stencil roll holder 11A is moved away from the regular position, the peeler support 12C swings under the urging force of the compression springs 12D, thereby moving the peeling member 12A to the non-contact position A1 shown in FIG. 6.

When the stencil roll holder 11A is at its regular position in the stencil perforating device 10, its push members 11G cause the legs of the peeler support 12C to swing back against the compression springs 12D. Thus, the peeling member 12A can move to come into contact with the outer surface of the stencil roll 16 (see FIG. 6), by its own weight, in accordance with the varying diameter of the stencil roll 16. When the stencil roll 16 has the maximum diameter as shown in FIG. 6, the peeling member 12A (labeled "12'" for convenience) is at the non-contact position A2. Conversely, when the stencil roll 16 has the minimum diameter, a limit diameter, the peeling member 12A (labeled "12A"" for convenience) is at the contact position A3.

Figure 7:
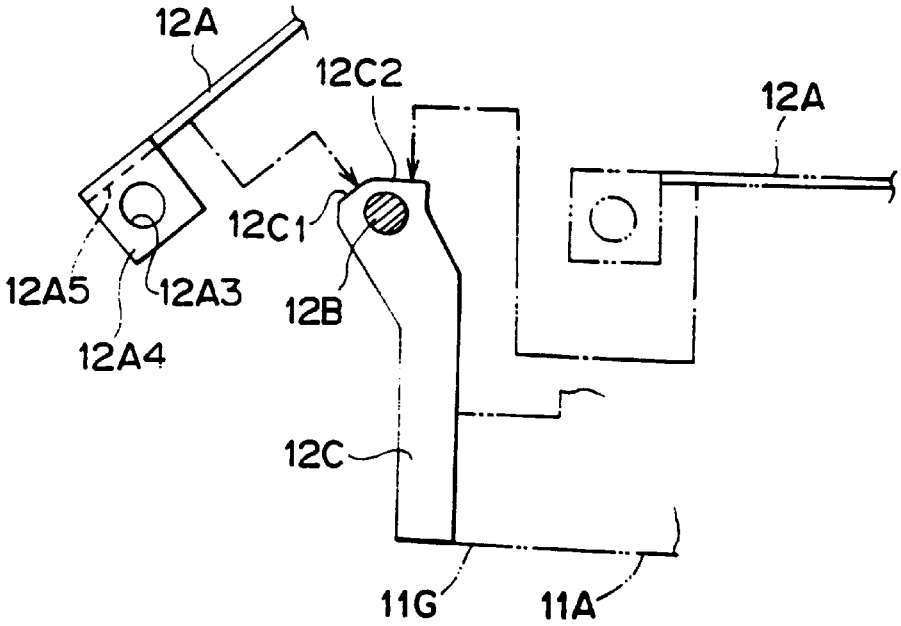
FIG. 7 is an exploded schematic view showing the main part of the stencil peeler of FIG. 6.
Figure 8:
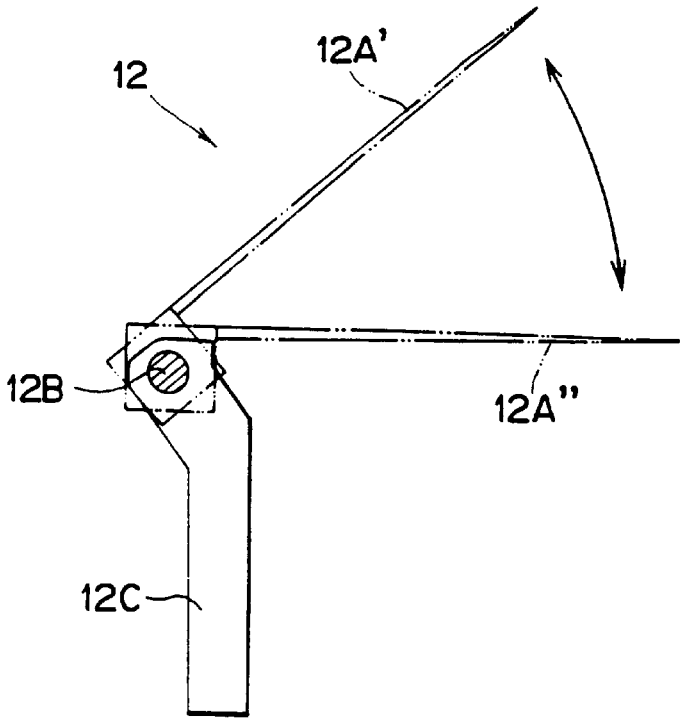
FIG. 8 is a schematic view showing one of the operations of the stencil peeler of FIG. 6.

For this purpose, the peeler support 12C has a top shaped as shown in FIG. 7 in order to support the peeling member 12A, as will be described later. FIGS. 7 and 8 show the state in which the peeler support 12C is pushed at its legs by the push members 11G of the stencil roll holder 11A against the action of the compression springs 12D, when the stencil roll holder 11A is placed in the stencil perforating device 10. Specifically, FIGS. 7 and 8 schematically show how the peeling member 12A moves itself in accordance with a varying diameter of the stencil roll which becomes thinner.

The peeler support 12C substantially looks like a gate when viewed in the direction of the stencil transport path, and extends across the stencil transport path. The peeler support 12C includes the legs, and a beam 12A5 spanning between the legs. The beam 12A5 supports the base of the peeling member 12A thereon. The peeler support 12C has a sloped portion 12C1, a flat portion 12C2, and a rounded portion which is between the foregoing portions 12C1 and 12C2. These portions are formed around the shaft 12B. The peeling member 12A changes its posture in accordance with the varying diameter of the stencil roll 16. The rounded portion serves to smooth the swinging of the front edge of the peeling member 12A, as shown in FIG. 7, and has a radius of rotation which is determined by assuming the shaft 12B as a center. The sloped portion 12C1 enables the front edge of the peeling member 12A to come into contact with the outer surface of the stencil roll 16 having the maximum diameter. The flat portion 12C2 enables the front edge of the peeling member 12A to come into contact with the stencil roll 16 having the minimum diameter (shown in FIG. 6).

When its legs are pushed by the push members 11G of the stencil roll holder 11A, the peeler support 12C is substantially upright as shown by the solid line in FIG. 6. In this state, the peeling member 12A is independent from the peeler support 12C, and freely swings so as to be in contact with the stencil 16*a* in accordance with the varying diameter of the stencil roll 16 (within a range shown by reference numerals A2 and A3 in FIG. 6).

When released from the push members 11G, the peeler support 12C turns about the shaft 12B, and inclines as shown by another projection line in FIG. 6. In this state, the peeling member 12A swings to the non-contact position A1 shown in FIG. 6 with its beam 12A5 being on the flat portion 12C2 of the peeler support 12C.

This structure of the peeler support 12C allows the peeling member 12A to be in continuous contact with the stencil roll 16 whose diameter varies from maximum to minimum.

Referring to FIG. 2, the platen pressure controller 14 is located downstream of the stencil peeler 12 in the stencil pay-out direction T. The platen pressure controller 14 includes the thermal head 14A and the platen roller 14B. The thermal head 14A has a conventional function of selectively and thermally perforating the stencil 16*a*. The thermal head 14A is selectively moved into contact with or out of contact from the platen roller 14B by a mechanism which will be described later.

The platen roller 14B is rotatable to convey the stencil 16*a* from the stencil roll 16 to a point downstream of the stencil transport path in cooperation with the thermal head 14A. The function of the platen roller 14B is well-known.

The platen roller 14B faces the thermal head 14A, and is rotated by a platen motor (not shown) via a drive transmission mechanism (not shown) as in a stencil perforating device of the prior art. For example, the platen motor may be a stepping motor.

The thermal head 14A and the platen roller 14B selectively come into contact with or out of contact from each other in order to exert a pressure on the stencil 16*a* or cancel the pressure.

A head support arm 14A2 rocks about a shaft 14A1 supported by the previously mentioned opposite side walls. The thermal head 14A is disposed on a surface of the head support arm 14A2. The other or rear surface of the head support 14A2 rests on an eccentric cam 14A3. A motor 14A30 for the eccentric cam 14A3 (shown in FIG. 9, called "cam motor 14A30" hereinafter) is affixed to the right side wall, and rotates the eccentric cam 14A3. Tension springs 14A4 extend between the head support arm 14A2 and the respective side walls. Thus, the head support arm 14A2 is continuously urged to move from the platen roller 14B as shown in FIG. 2. The eccentric cam 14A3 is in continuous contact with the rear surface of the head support arm 14A2.

The eccentric cam 14A3 functions as a pressure canceling member, and is in contact with the head support arm 14A2 via its smaller diameter portion when the stencil perforating device 10 is not perforating the stencil 16*a*. In such a state, the thermal head 14A on the head support arm 14A2 is spaced from the stencil transport path, canceling the pressure acting on the stencil 16*a*.

When the thermal head 14A is brought into contact with the platen roller 14B, the platen roller 14B is rotated by the platen motor in the direction for paying the stencil 16*a* out from the stencil roll 16.

The platen pressure controller 14 operates as follows. When perforating the stencil 16*a*, the eccentric cam 14A3 is rotated and is in pressure contact with the rear of the head support arm 14A2 via its large diameter portion.

Specifically, the eccentric cam 14A3 pushes the head support arm 14A2 at its large diameter portion, so that the thermal head 14A moves upward, as viewed in FIG. 2.

Accordingly, the thermal head 14A comes into contact with the platen roller 14B. In this state, the platen roller 14B conveys the stencil 16*a* while pressing it against the thermal head 14A. The thermal head 14A selectively heats its heating elements so as to perforate the stencil 16*a* in the main and sub-scanning directions. It is to be noted that the main scanning direction lies along the length of the platen roller 14B, and that the sub-scanning direction is orthogonal to the main-scanning direction, i.e. the stencil pay-out direction T.

In this embodiment, the thermal head 14A moves to and from the platen roller 14B. Alternatively, the platen roller 14B may move to and from the thermal head 14A.

When the leading edge of the stencil 16*a* is carried to the thermal head 14A from the stencil roll 16, the eccentric cam 14A3 may be continuously rotated for a short period of time. This allows the thermal head 14A to repeatedly come into contact with and out of contact from the platen roller 14B with the stencil 16*a* sandwiched therebetween. When the platen roller 14B is rotated in the stencil pay-out direction T in response to the foregoing repeated movement of the thermal head 14A, the stencil 16*a* present at the platen pressure controller 14 is then intermittently pulled toward the downstream of the stencil transport path. Thus, the friction acting on the opposite side edges of the stencil roll 16 (in the space 11A4 of the stencil roll holder 11A) is effective in eliminating creases or other deformation of the stencil 16*a*.

When the stencil perforating device 10 is not perforating the stencil 16*a*, the eccentric cam 14A3 rotates and comes into contact with the rear of the head support arm 14A2 via its small diameter portion. In this state, the thermal head 14A is spaced from the platen roller 14B, so that no pressure is applied to the stencil 16*a*.

Referring to FIGS. 1 and 2, a cutter 17 is located downstream of the platen pressure controller 14 on the stencil transport path. The cutter 17 cuts the leading or trailing edge of the stencil 16*a*. A guillotine cutter or a rotary cutter may be used as the cutter 17.

In FIGS. 1 and 2, a pair of stencil feed rollers 18 and a guide 19 are positioned downstream of the cutter 17 on the stencil transport path. The guide 19 guides the stencil 16*a* toward the clamp 2D of the print drum 2. The stencil 16*a* is cut at its leading edge to a predetermined length by the cutter 17, and is conveyed by stencil feed rollers 1B until its leading edge arrives at the stage 2E.

In this state, the clamping member 2F is away from the stage 2E. The clamping member 2F is then closed to hold the leading edge of the stencil 16*a* in cooperation with the stage 2E. One of the stencil feed rollers 18 is connected to a feed roller motor 18A (see FIG. 9) affixed to the side wall, and is rotated thereby.

Alternatively, the feed rollers 18 may have the following configuration: a gear may be mounted on the end of the shaft of the stencil feed rollers 18, and be engaged with a drive gear mounted on the output shaft of the platen motor. In such a case, an electromagnetic clutch will be provided between the shaft of the stencil feed rollers 18 and the gear. Further, the foregoing components may be used in combination.

A document reading unit (not shown) is disposed in the upper portion of the stencil printer 1 shown in FIG. 1.

The document reading unit includes a scanner having a platen glass. Light from a light source in the scanner is incident onto an original document laid on the platen glass. Light reflected from the document is routed to a CCD (Charge Coupled Device) or a similar image sensor via optics including mirrors and a lens. The image sensor generates image data on the basis of the reflected light, and provides them to a control unit which will be described later. The stencil perforating device 10 perforates the stencil 16*a* in accordance with the image data.

FIG. 1 shows the used stencil discharging unit 20 located above and at the left side of the print drum 2.

The used stencil discharging unit 20 includes upper and lower discharge members 20A and 20B, and a used stencil box 21.

Each of the discharge members 20A and 20B has a pair of rollers which are near the print drum 2 and the used stencil box 21, and a belt extending therebetween. The discharge members 20A and 20B confront with each other, and are present near the print drum 2. The belt strips a used stencil 16*a* off from the print drum 2, and conveys it to the used stencil box 21. The lower discharge member 20B moves toward the outer surface of the print drum 2 when the print drum 2 is rotated counterclockwise so as to discharge the used stencil 16*a*. When it comes near the print drum 2, the lower discharge chamber 20B catches the trailing edge of the stencil 16*a*, and conveys it toward the used stencil box 21.

A compressing member 22 is positioned above the used stencil box 21, and is movable up and down. Each time the used stencil 16*a* is discharged into the used stencil box 21, the compressing member 22 compresses it in order to prepare a space for storing a next used stencil 16*a*. The used stencil box 21 full with such used stencils 16*a* is removed from the stencil printer 1 in order to discharge them.

Referring to FIG. 1, a sheet separator 30 is positioned below and downstream of the print drum 2 which rotates clockwise (as indicated by an arrow). The sheet separator 30 has a free end movable to and from the outer surface of the print drum 2, and separates the printed sheet S from the print drum 2. The separated sheet S is carried to a conveyor 41.

The conveyor 41 has an endless belt 44 extending round a pair of rollers 42 and 43, and constitutes the print discharging unit. The sheet S separated from the print drum 2 is conveyed on the belt 44 to a printed sheet tray 45. A suction fan 46 is positioned below the conveyor 41. The suction fan 46 enables the belt 44 to attract the sheet S thereon by suction. The printed sheet tray 45 may be structured so as to angularly turn around a shaft such that it may be upright or flat relative to the wall of the stencil printer 1.

Figure 9:
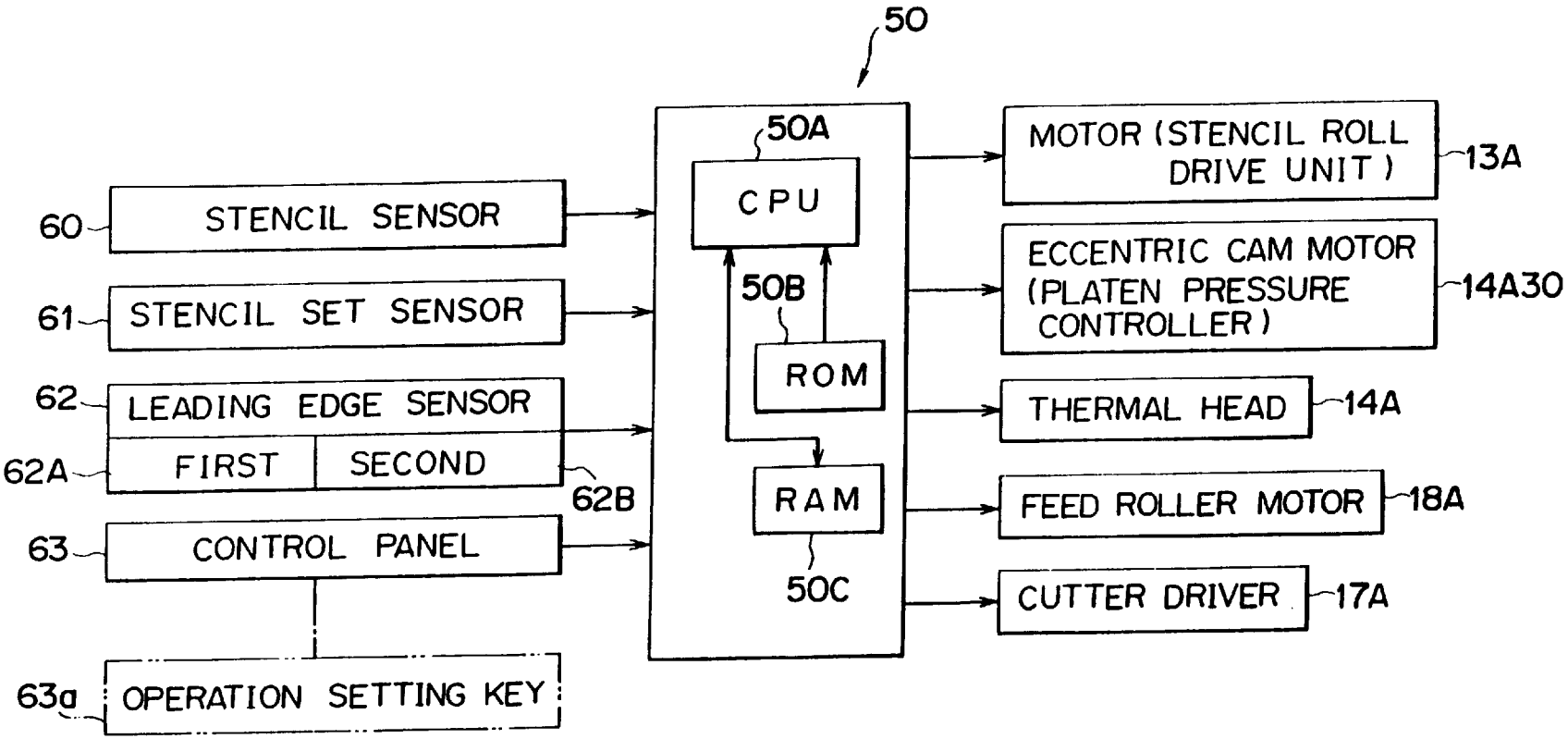
FIG. 9 is a block diagram of a control unit used in the stencil perforating device of FIG. 2.

FIG. 9 shows the configuration of a control unit 50 which executes various control operations including the control over the stencil perforating device 10 based on the image data from the document reading unit. The control unit 50 includes a microcomputer CPU (Central Processing Unit) 50A, a ROM (Read Only Memory) 50B, and a RAM (Random Access Memory) 50C. The ROM 50B stores a basic program for controlling the sequence from the reading of an original image till the delivery of the printed sheet S. The RAM 50C stores data.

The parts of the control unit 50 relevant to the crux of the embodiment will be described hereinafter. The document reading unit, stencil sensor 60, stencil set sensor 61, leading edge sensor 62, and control panel 63 are respectively connected to an input side of the control unit 50 via an I/O (Input/Output) interface (not shown). Connected to the output side of the control unit 50 are the motor 13A of the stencil roll drive unit 13, cam motor 14A30 of the platen pressure controller 14, platen motor for the platen roller 14B, the thermal head 14A, feed roller motor 18A for driving the feed rollers 18, and driver 17A for the cutter 17 (called the "cutter driver 17A).

It is to be noted that an operation setting key 63*a* (enclosed by a dash-and-dots line in FIG. 9) is a control element which is not used in the first embodiment.

As shown in FIGS. 1 and 2, the stencil sensor 60 is a reflection type photosensor mounted on the bottom of the guide 15, and has a light emitting element and a photosensitive element. When the stencil roll 16 is loaded into the space 11A4 of the stencil roll holder 11A, the sensor 60 senses the presence of the stencil roll 16 on the basis of light reflected therefrom.

The stencil sensor 60 also detects the limit diameter of the stencil roll 16. The stencil 16*a* has the black end mark 16A having low reflectance, as described with reference to FIG. 10. When the stencil roll 16 reaches its limit diameter due to the consumption of the stencil 16*a*, the stencil sensor 60 senses the end mark 16A, and outputs a signal representative of the reduced reflectance. In response to this signal, the control unit 50 determines that the paying-out of the stencil 16*a* should be stopped.

When the stencil roll holder 11A is returned into the stencil perforating device 10, the stencil set sensor 61 detects the movement of the peeler support 12C (of the stencil peeler 12) by the push members 11G (of the stencil roll holder 11A). The peeler support 12C has, on the bottom of its legs, a reflecting surface (not shown) for reflecting incident light. In this embodiment, the stencil set sensor 61 is a reflection type photosensor, and detects the movement of the foregoing reflecting surface of the peeler support 12C. In addition, the stencil set sensor 61 serves as an operation sensor for determining the operation timing of the motor 13A of the stencil roll drive unit 13 in response to the movement of the peeler support 12C, and feeds an output signal to the control unit 50.

The leading edge sensor 62 shown in FIGS. 1 and 2 has first and second leading edge sensing members 62A and 62B (called the "first sensing member 62A" and "second sensing member 62B", respectively). In the stencil transport path, the first sensing member 62A is positioned upstream of the platen roller 14B while the second sensing member 62B is present downstream of the cutter 17.

The first and second sensing members 62A and 62B are reflection type photosensors, each having a light emitting element and a photosensitive element. On detecting the leading edge of the stencil 16*a*, the first sensing member 62A outputs a reference signal for driving the platen pressure controller 14. The second sensing member 62B issues another reference signal for enabling the stencil 16*a* to be continuously paid out for a predetermined period of time. The amount of the stencil 16*a* to be fed in response to the signal of the second sensing member 62B is determined such that the leading edge of the stencil 16*a* faces the clamp 2D.

The control panel 63 has a perforation start switch and numeric keys arranged on its surface, which are not shown in the drawing figures. The numeric keys are used for entering the number of prints to be produced. The perforation start switch is pressed so as to wrap a perforated new stencil 16*a* around the print drum 2. The operation of this switch enables the stencil 16*a* to be automatically paid out from the stencil roll 16 toward the platen pressure controller 14, to be perforated, and to be wrapped round the print drum 2. In this state, a single sheet S is fed to the print drum 2, and the ink oozes to the sheet S via the perforated stencil 16*a*. Thus, a single trial print is produced. A print start switch (not shown) is pressed on the control panel 63 in order to start a sequence of the printing operation.

When no output signals are received from the stencil sensor 60 and the stencil set sensor 61, the control unit 50 does not activate the motor 13A of the stencil roll drive unit 13. The control unit 50 simultaneously activates the cam motor 14A30 of the platen pressure controller 14, which rotates the eccentric cam 14A3 until it comes into contact with the head support arm 14A2 via its small diameter portion. However, the control unit 50 does not activate the platen motor for the platen roller 14B. In this state, the thermal head 14A and the platen roller 14B are out of contact from each other, and do not hold the stencil 16*a*, and are unable to convey or perforate it.

Conversely, when receiving the signals from the sensors 60 and 61, the control unit 50 activates the motor 13A, and allows the stencil 16*a* to be paid out from the stencil roll 16.

In this state, the motor 13A is reversely rotated once, and is then rotated in the stencil pay-out direction, as described earlier. Thus, it is possible to reliably position the leading edge of the stencil 16*a* against the peeling member 12A, and to peel the leading edge of the stencil 16*a* off from the stencil roll 16. For example, if the leading edge of the stencil 16*a* is present near but downstream of the peeling member 12A, the foregoing reverse rotation of the motor 13A returns the leading edge of the stencil 16*a* to the position where it faces the peeling member 12A. Therefore, when the stencil roll 16 is rotated in the stencil pay-out direction, it is possible to reduce the interval before the leading edge of the stencil 16*a* is peeled and separated off from the stencil roll 16.

When the first sensing member 62A senses the leading edge of the stencil 16*a*, the control unit 50 causes the stencil roll drive unit 13 to continue rotating the stencil roll 16 for the predetermined time period, and then to stop the stencil roll 16. During the continuous rotation of the stencil roll 16, the leading edge of the stencil 16*a* is moved into the space between the thermal head 14A and the platen roller 14B.

At the same time, the control unit 50 activates the cam motor 14A30 in order to move the head support arm 14A2 (FIG. 2) toward the platen roller 14B. The thermal head 14A and the platen roller 14B exert a pressure on the stencil 16*a*, and hold it therebetween.

The platen roller 14B is then rotated by the platen motor in order to convey the stencil 16*a* in cooperation with the thermal head 14A.

In response to the signal from the second sensing member 62B, the control unit 50 rotates the platen motor and the feed roller motor 18A by a predetermined extent. This causes the leading edge of the stencil 16*a* to be carried into the space between the opened clamping member 2F and the stage 2E on the print drum 2.

Figure 16:
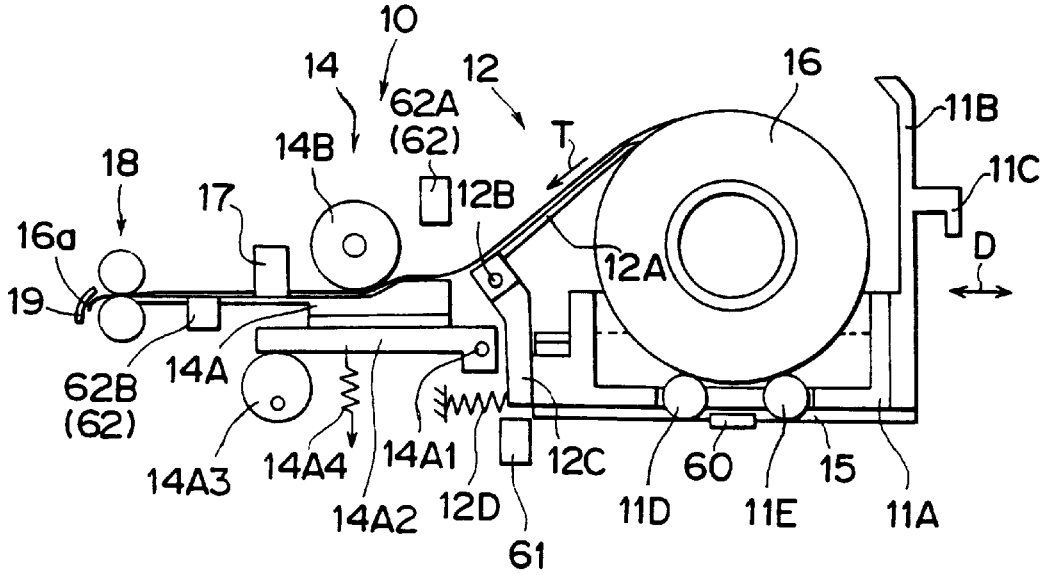
Figure 17:
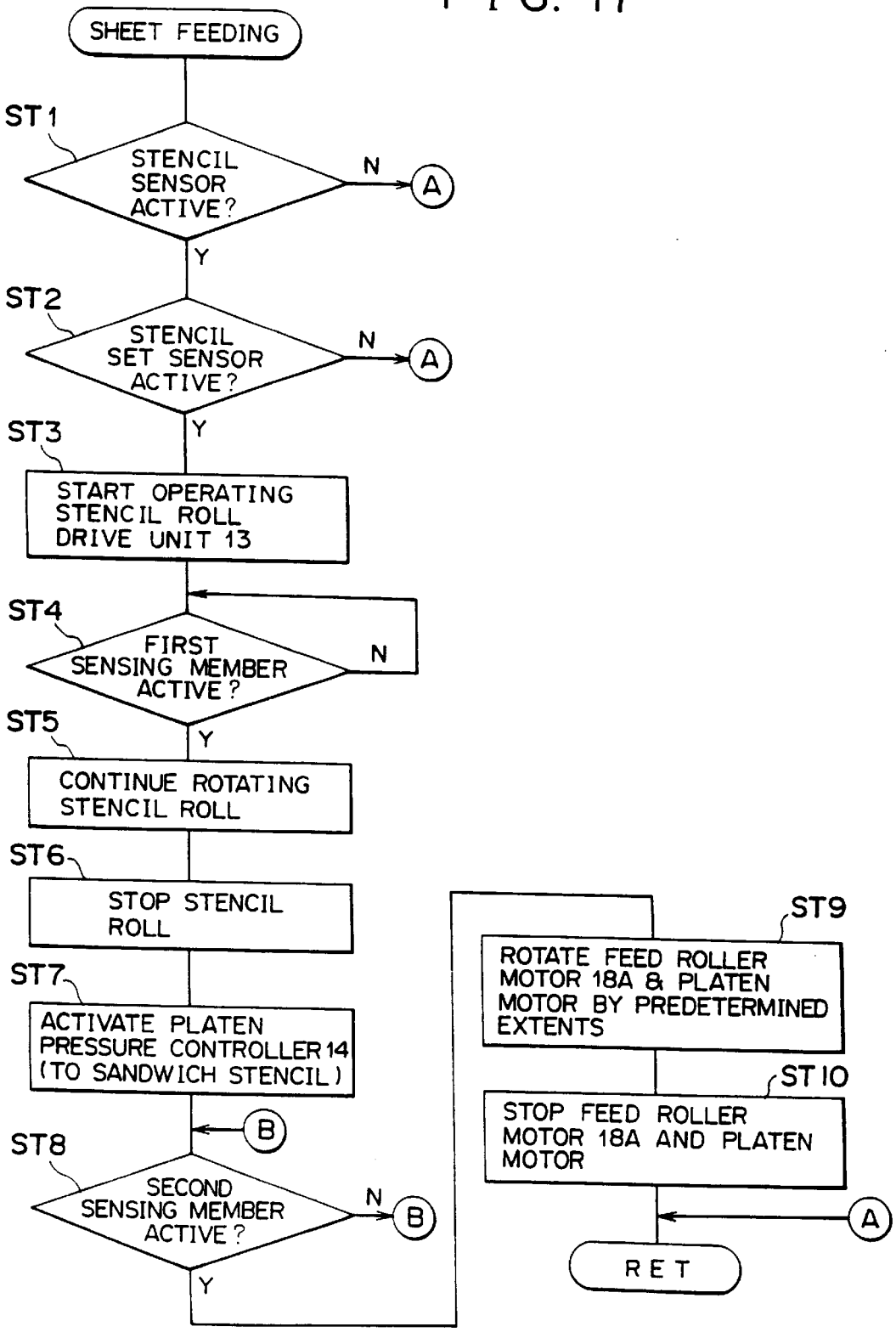
FIG. 17 is a flowchart showing the operation of the control unit shown in FIG. 9.
Figure 18:
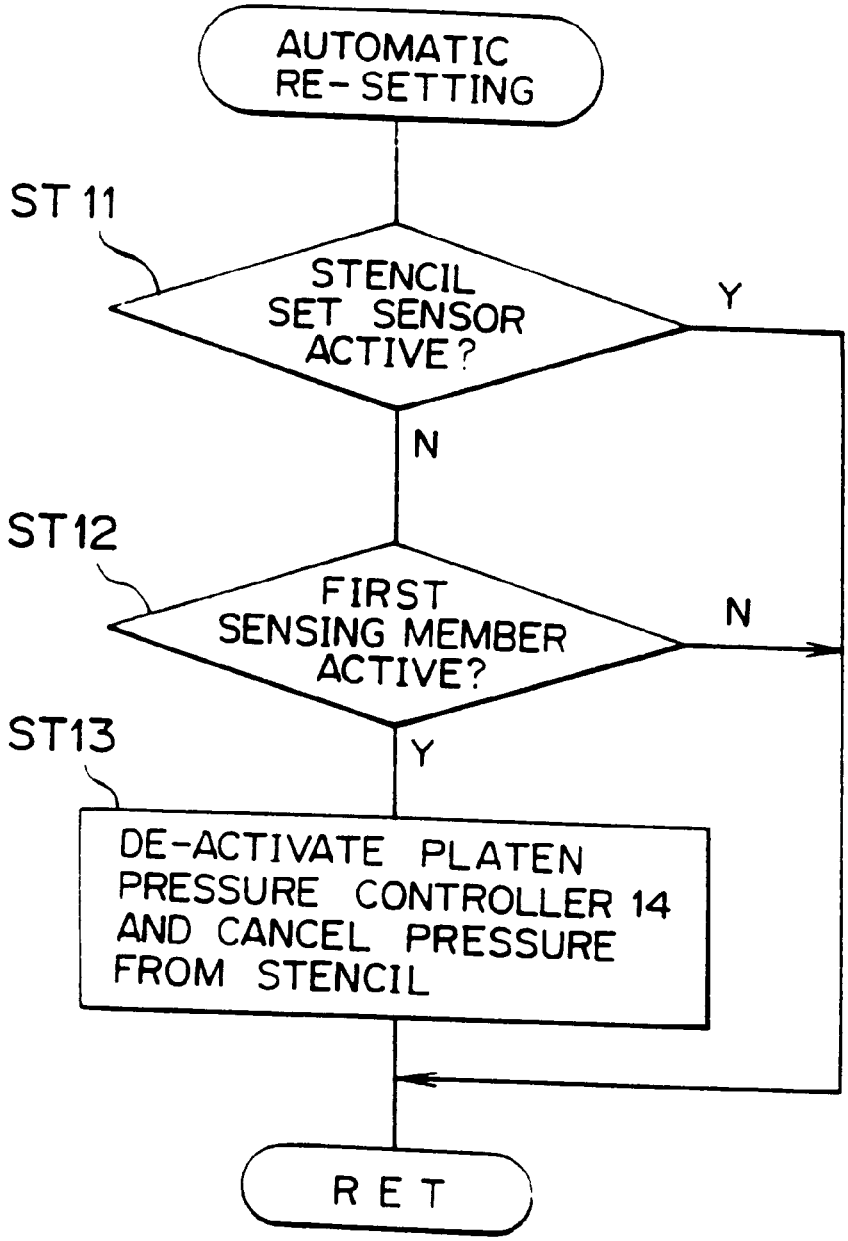
FIG. 18 is a flowchart showing another operation of the control unit.

Reference will be made to FIGS. 11 to 16 showing the pay-out of the stencil 16*a* from the stencil roll 16, and FIGS. 17 and 18 showing the operation of the control unit 50. In order to facilitate the understanding of the operation, FIGS. 11 to 16 are slightly schematic compared with FIG. 2.

Figure 11:
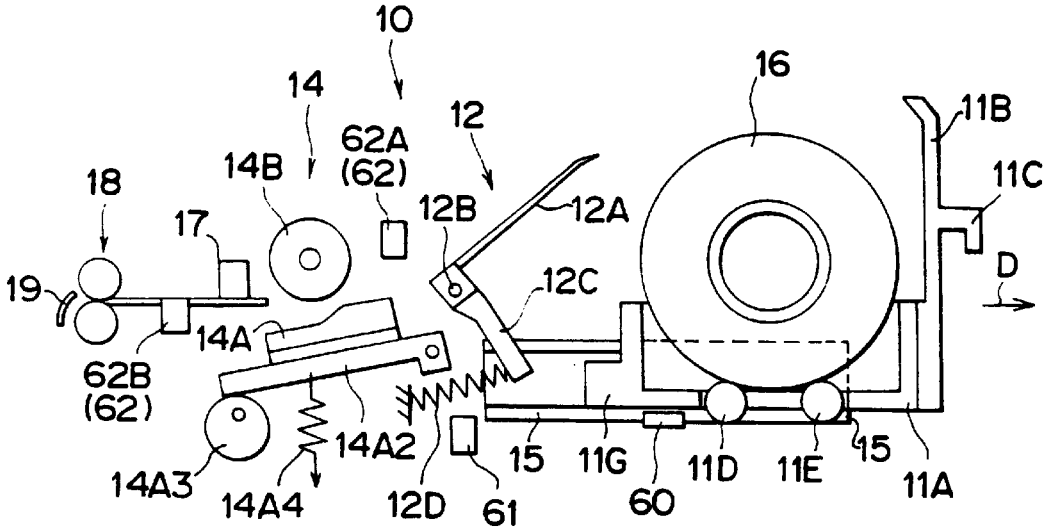
FIG. 11 schematically shows the stencil perforating device of FIG. 2 in its initial state.

FIG. 11 shows the state in which a fresh stencil roll 16 is loaded into the stencil roll holder 11A. Prior to placing the fresh stencil roll 16, the operator pulls the handle 11C in order to move the stencil roll holder 11A outward.

The more the stencil 16*a* is consumed, the thinner the stencil roll 16. When the stencil 16*a* is used up to its limit, not all of the light emitted by the stencil sensor 60 is reflected because of the end mark 16A shown in FIG. 10, i.e. the amount of light returned to the stencil sensor 60 is reduced. The stencil sensor 60 continuously monitors the amount of reflected light. Sensing the amount of reflected light which is below the predetermined value, the stencil sensor 60 outputs a signal indicative of this state to the control unit 50. In response to the signal, the control unit 50 enables the stencil roll holding unit 11 to be moved outward.

In the platen pressure controller 14, the cam motor 14A30 rotates the eccentric cam 14A3 until it comes into contact with the head support arm 14A2 via its smaller diameter portion. Thus, the thermal head 14A is released from the platen roller 14B, and cancels the pressure acting on the stencil 16*a*. This stops the rotation of the platen motor and the platen roller 14B.

When the stencil roll holder 11A is pulled outward, the push members 11G move away from the peeler support 12C.

Thus, the peeler support 12C swings as shown in FIG. 11, so that the front edge of the peeling member 12A leaves the stencil roll 16.

In this state, the stencil roll 16 is smoothly detached from the stencil perforating device 10 since no resistance acts on the stencil roll 16. A fresh stencil roll 16 is loaded into the space 11A4 of the stencil roll holder 11A. The stencil roll holder 11A is then returned to its regular position in the stencil perforating device 10, as shown in FIG. 12.

Figure 12:
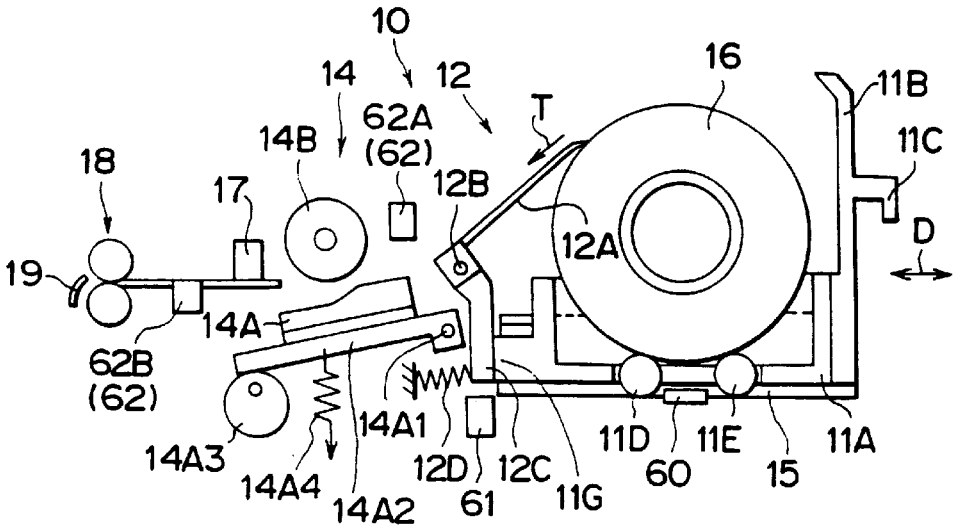
FIG. 12 schematically shows the state of the stencil perforating device in which the stencil roll holding unit is at its regular position.

When the stencil roll holder 11A reaches its regular position, the push members 11G push the peeler support 12C back to the position shown by the solid line in FIG. 12, so that the peeling member 12A comes into contact with the predetermined position of the stencil roll 16.

At the same time, the stencil sensor 60 senses the presence of the usable stencil roll 16 while the stencil set sensor 61 determines that the stencil roll holding unit 11 is at its regular position.

The perforation start switch is pressed on the control panel 63, so that the control unit 50 executes the procedure shown in FIG. 17. First of all, the control unit 50 checks the presence of the signals outputted by the stencil sensor 60 and the stencil set sensor 61 (steps ST1 and ST2). When the signals have been received, the control unit 50 activates the motor 13A so as to operate the stencil roll drive unit 13 (step ST3).

The motor 13A rotates the stencil drive rollers 11D and 11E in order to pay the leading edge of the stencil 16*a* out from the stencil roll 16. Specifically, the motor 13A rotates the rollers 11D and 11E counterclockwise once, and then rotates them clockwise, or in the stencil pay-out direction (shown by the arrow in FIG. 13).

Concurrently with the operation of the stencil roll drive unit 13, the control unit 50 checks the presence of the output signal from the first sensing member 62A (step ST4).

When the foregoing signal is present, the control unit 50 enables the stencil roll drive unit 13 to continue its operation (step ST5). In this state, the leading edge of the stencil 16*a* is allowed to reach the platen pressure controller 14.

Figure 14:
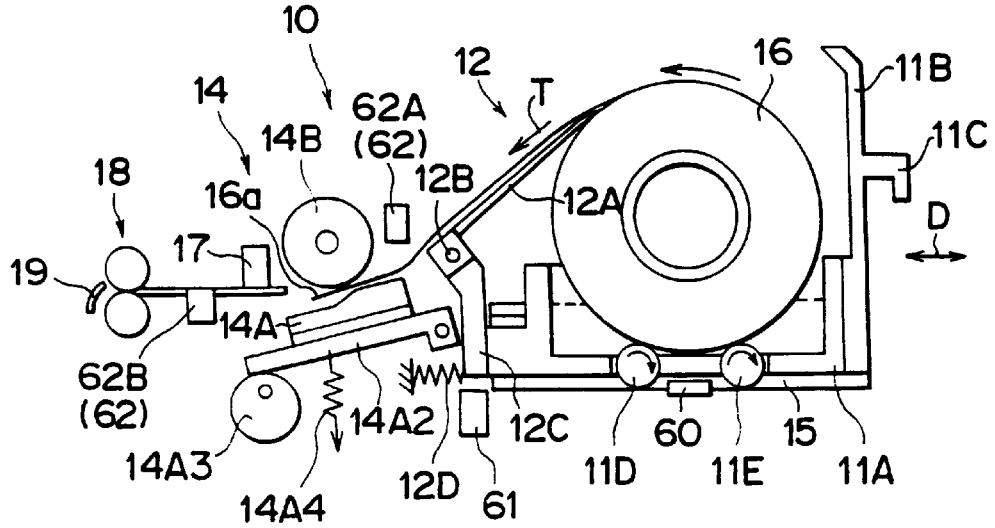
FIG. 14 schematically shows the state of the stencil perforating device when the leading edge of the stencil reaches a position where a thermal head and a platen roller face each other.
Figure 15:
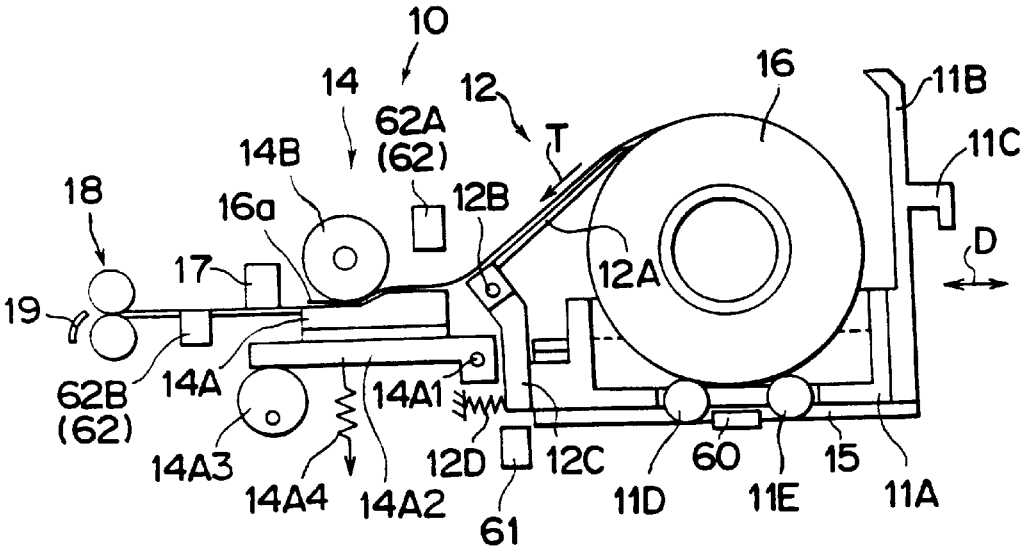
FIG. 15 schematically shows that the leading edge of the stencil is sandwiched between the thermal head and the platen roller in the stencil perforating device, FIG. 16 schematically shows the stencil perforating device in a state ready for perforation.

During the continuous rotation of the motor 13A, the stencil 16*a* is conveyed approximately 20 mm from the first sensing member 62A to the space between the platen roller 14B and the thermal head 14A. In other words, the motor 13A is rotated by a predetermined extent necessary for guiding the leading edge of the stencil 16*a* toward the downstream side of the stencil transport path, as shown in FIG. 14.

The control unit 50 then stops the stencil roll drive unit 13 (step ST6). In order to determine the time for interrupting the rotation of the motor 13A, a rotary encoder or a similar roll rotation sensor (not shown) senses the rotation amount of the motor 13A, and outputs a signal to the control unit 50.

In response to the signal, the control unit 50 controls the platen pressure controller 14 (step ST7). Specifically, the control unit 50 causes the thermal head 14A to come into contact with the platen roller 14B and to hold the stencil 16*a* therebetween. For this purpose, the control unit 50 drives the cam motor 14A30 such that the eccentric cam 14A3 comes into contact with the rear of the head support arm 14A2 via its large diameter portion. The head support arm 14A2 then moves the thermal head 14A toward the platen roller 14B. In this state, the thermal head 14A and the platen roller 14B can convey the stencil 16*a* held therebetween.

In the foregoing state, the eccentric cam 14A3 is continuously rotated for a short period of time so as to repeatedly bring the thermal head 14A into contact with and out of contact from the platen roller 14B via the stencil 16*a*. At the same time, the platen roller 14B is rotated clockwise, as viewed in FIG. 15, in order to convey the stencil 16*a* downstream in the stencil transport path. Thus, the stencil 16*a* is intermittently pulled by the platen roller 14B, and is prevented from being creased or deformed.

During the operation following step ST6, the stencil 16*a* is paid out from the stencil roll 16 by the rotation of the platen roller 14B. The stencil roll 16 is rotated while slipping on the rollers 11D and 11E.

In step ST7, each time the thermal head 14A is brought into contact with and out of contact from the rotating platen roller 14B, the stencil 16*a* is paid out from the stencil roll 16 to the second sensing member 62B. Thus, the leading edge of the stencil 16*a* is detected by the second sensing member 62B (step ST8).

Thereafter, the platen motor and the feed roller motor 18A are rotated by the predetermined amounts such that the platen roller 14B and the feed rollers 18 rotate to bring the leading edge of the stencil 16*a* to the position where it faces the clamp 2D (step ST9). In this state, the stencil 16*a* is ready for perforation as shown in FIG. 16. In this case, the stencil 16*a* is carried 25 mm which corresponds to the distance between the platen pressure controller 14 and the position where the stencil 16*a* faces the clamp 2D on the print drum 2.

Similarly to the time to stop the stencil roll drive unit 13, the time to stop the platen motor and feed roller motor 18A is determined by sensing the rotation amount of the platen motor via a signal generator such as a rotary encoder.

In step ST9, the platen motor and the feed roller motor 18A are rotated by the predetermined amount. Then, these motors are stopped (step ST10).

FIG. 18 shows a procedure for the platen pressure controller 14 to cancel the pressure acting on the stencil 16*a* (labeled "AUTOMATIC RE-SETTING"). In order to move the stencil roll holder 11A from its regular position in the stencil perforating device 10, this procedure is executed so as to cancel the pressure from the stencil 16*a*, and allows the stencil holder 11A to be smoothly pulled outward.

Referring to FIG. 18, the control unit 50 checks whether or not the signals are outputted from the stencil set sensor 61 and the first sensing member 62A (steps ST11 and ST12). When no signal arrives from the stencil set sensor 61 but the signal from the first sensing member 62A is present, the platen pressure controller 14 cancels the pressure from the stencil 16*a* (step ST13).

In step ST13, the cam motor 14A30 rotates the eccentric cam 14A3 until it comes into contact with the thermal head support arm 14A2 via its small diameter portion. Therefore, the thermal head 14A leaves the platen roller 14B, so that the pressure is canceled from the stencil 16*a*.

However, if the stencil 16*a* is nipped by the platen roller 14B and the thermal head 14A when the stencil roll holder 11A starts moving outward, tension applied to the stencil 16*a* makes the stencil roll 16 rotate in the space 11A4. This enables the stencil 16*a* to be unwound and to become slack on the stencil roll 16, and prevents the stencil 16*a* from being broken from the stencil roll 16.

The leading edge of the stencil 16*a* is brought to the position where it faces the clamp 2D of the print drum 2, and is nipped by the clamping member 2F and the stage 2E. Thereafter, the thermal head 14A selectively and thermally perforates the stencil 16*a* while conveying it in cooperation with the platen roller 14B. The perforated stencil 16*a* is sequentially wrapped round the print drum 2 rotating clockwise continuously or intermittently.

In the succeeding printing process, each time the used stencil 16*a* is taken up from the print drum 2, a fresh part of the stencil 16*a* is paid out from the stencil roll 16, is perforated, and is wrapped round the print drum 2 in order to continue the printing operation.

The first embodiment is advantageous in the following respects. Each time a fresh stencil roll 16 is loaded in the stencil roll holding unit 11 and is moved to its regular position in the stencil perforating device 10, the leading edge of the stencil 16*a* is automatically paid out from the stencil roll 16 simply by moving the stencil roll holding unit 11, so that the stencil 16*a* is perforated.

The peeling member 12A is the thin elastic member. When it comes into contact with the stencil roll 16, the peeling member 12A elastically deforms itself so as not to exert any unnecessary pressure on the stencil roll 16. This protects the surface of the stencil 16*a* against being scratched and being torn off.

Further, the peeling member 12A has the front edge which is substantially curved from its center toward its opposite side edges. Specifically, the peeling member 12A gradually approaches or comes into contact with the leading edge of the stencil 16*a* via its curved front edge. First of all, the peeling member 12A peels the center of the leading edge of the stencil 16*a* off from the stencil roll 16, and then gradually peels and separates the remaining portions of the stencil 16*a* toward its opposite side edges. Thus, it is possible to prevent the leading edge of the stencil 16*a* from being caught by the peeling member 12A, and from being jammed in its transport path.

Specifically, the peeling member 12A comes into contact with the stencil 16*a* via its downward projection 12A1, which minimizes the contacting area therebetween, and enables the stencil 16*a* to be smoothly paid out and reliably separated from the stencil roll 16.

The peeling member 12A can contact with the stencil roll 16 by its own weight without the assistance of any special urging member.

(Modified Example 1 of the First Embodiment)

Figure 19:
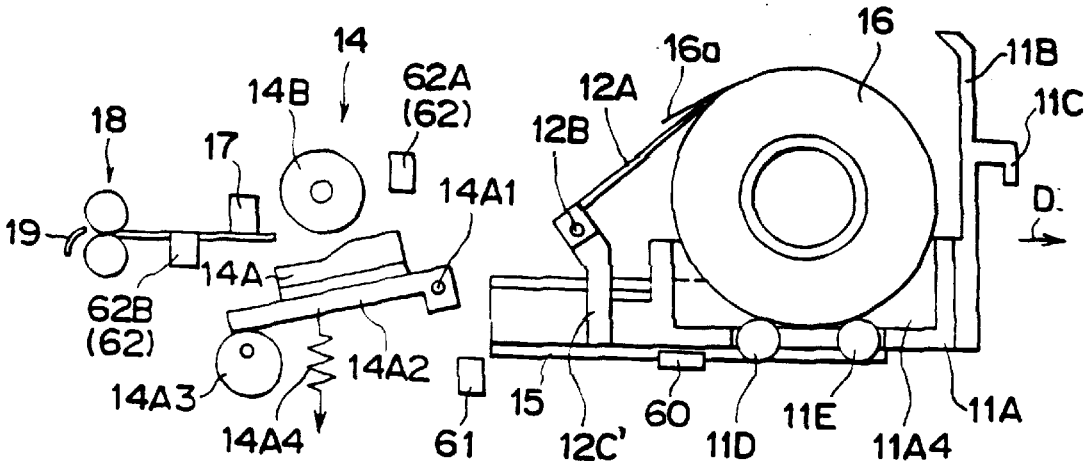
FIG. 19 schematically shows a first modification of the stencil perforating device.

A first modification of the first embodiment will be described with reference to FIG. 19. In the first embodiment, the stencil roll drive unit 13 is activated to automatically pay out the leading edge of the stencil 16*a* from the stencil roll 16 after the stencil roll 16 is loaded in the space 11A4 of the stencil roll holder 11A. Alternatively, the leading edge of the stencil 16*a* may be manually peeled off, separated and paid out from the stencil roll 16.

In this modification, a fresh stencil roll 16 is placed in the stencil roll holder 11A pulled outward in the direction D. Then, the operator manually peels the leading edge of the stencil 16*a* off from the stencil roll 16, feeds it toward the top of the peeling member 12A, and returns the stencil roll holder 11A into the stencil perforating device 10.

Thereafter, the procedure substantially identical to that shown in FIG. 17 is performed in response to the output signal from the stencil sensor 60.

This modification mainly differs from the first embodiment in the following respects. Specifically, as shown in FIG. 19, a peeler support 12C' is used in place of the peeler support 12C, and is affixed to the stencil roll holder 11A at the two positions where the push members 11G are disposed in the first embodiment. No compression springs 12D are necessary in this modification. The peeler support 12C' is slidable on the guide members 15 together with the stencil roll holder 11A. A shaft 12B' is affixed to the stencil roll holding unit 11.

(Modified Example 2 of the First Embodiment)

Figure 20:
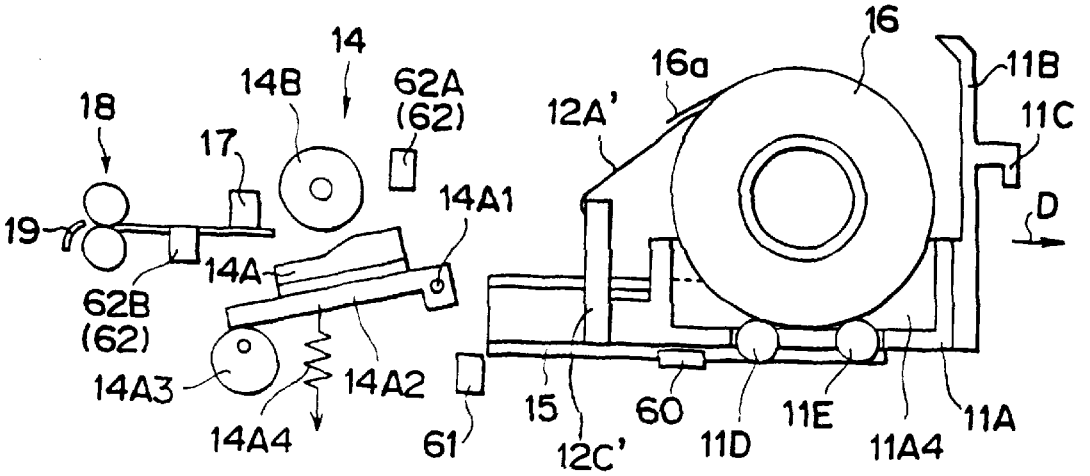
FIG. 20 is a schematic view of a second modification of the stencil perforating device.

FIG. 20 shows a second modification of the first embodiment, in which the leading edge of the stencil 16*a* is manually peeled off, separated and paid out from the stencil roll 16. A peeling member 12A' is fixedly attached to the peeler support 12C' which is fixedly supported near one end of the stencil roll holder 11A. The front edge of the peeling member 12A' is maintained stationary in the vicinity of the outer surface of the stencil roll 16 such that it does not swing to and from the stencil roll 16.

In these modified examples, the leading edge of the stencil 16*a* is manually paid out to the predetermined length from the stencil roll 16, and is laid on the peeling member 12A or 12A'. The stencil roll holder 11A is then returned into the stencil perforating device 10. The procedure shown in FIG. 17 is carried out from the step ST1 onward. In these examples, the leading edge of the stencil 16*a* is manually laid on the peeling member 12A or 12A', so that the reverse rotation of the rollers 11D and 11E in step ST3 is not executed.

Alternatively, the stencil sensor 60 and the stencil set sensor 61 may be replaced with a sensor which is mounted on the stencil perforating device 10 and is responsive to the movement of the closure member 11B to its closed position. This sensor may be used for determining the time to start paying out the stencil 16*a*.

In the first embodiment, the stencil set sensor 61 detects the time for the stencil roll drive unit 13 to start paying out the stencil 16*a*. Alternatively, the stencil sensor 60 may be used for this purpose. This is because the stencil sensor 60 checks the presence of the stencil roll 16 in the space 11A4 in the stencil perforating device 10.

Alternatively, the foregoing sensors 60 and 62 are dispensable if the operation setting key 63*a* (FIG. 9) is provided on the control panel 63 so as to enable the operator to set the time for the stencil roll drive unit 13 to start operating. In this case, the operator presses the operation setting key 63*a* after returning the stencil roll holder 11A into the stencil perforating device 10. Thereafter, the control unit 50 will activate the stencil roll drive unit 13 in response to a signal from the operation setting key 63*a*.

In the first embodiment, the platen pressure controller 14 smoothes a creased stencil 16*a* as follows. When the first sensing member 62A senses the leading edge of the stencil 16*a*, the thermal head 14A and the platen roller 14B are intermittently brought into contact with and out of contact from each other. However, this smoothing operation is not always necessary when the leading edge of the stencil 16*a* is conveyed in parallel to the axial direction of the platen roller 14B without any crease. Further, the creased stencil 16*a* may be smoothed as follows: the thermal head 14A and the platen roller 14B remain in contact with each other until the second sensing member 62B senses the leading edge of the stencil 16*a*, and the cam motor 14A30 is driven in response to the signal from the second sensing member 62B, so that the thermal head 14A and the platen roller 14B intermittently come into contact with each other. In such a case, the thermal head 14A and the platen roller 14B are freed from each other at least once.

With the first embodiment, the stencil roll rotating rollers 11D and 11E are in contact with the outer surface of the stencil roll 16 so as to drive it. Alternatively, the stencil roll 16 may be rotated by a roller which is in contact with the inner surface of the core 16B of the stencil roll 16. Further, it is possible to use a member which holds the stencil 16*a* paid out to a predetermined length and rotates the stencil roll 16 by pulling the stencil 16 therefrom.

The stencil perforating device of this invention is also applicable to a printer in which ink is supplied to the print drum from an outside source as in Japanese Patent Laid-Open Publication No. Hei 7-17013.

Figure 21:
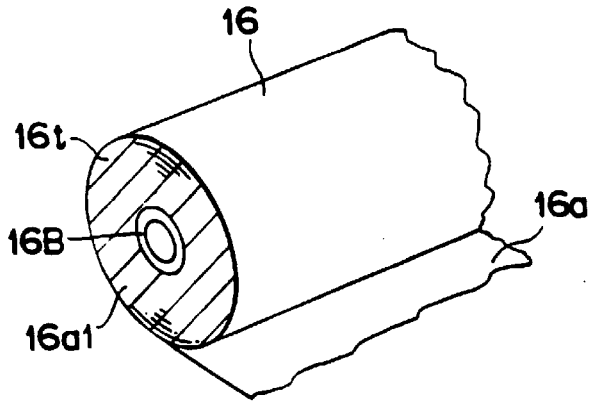
FIG. 21 is a perspective view of the main part of a stencil roll in a second embodiment of the invention which is used for the stencil perforating device in the first embodiment.

A second embodiment of the invention relates to a stencil roll 16 shown in FIG. 21. The stencil roll 16 includes the stencil 16*a* wound around the core 16B. In this embodiment, one side surface 16*t*, i.e. the left side surface, of the stencil roll 16 is applied with a paste 16*a*1 as shown in FIG. 21.

Each side surface 16*t* is an aggregate of side edges of the stencil 16*a* repeatedly wound around the core 16B. On the pasted side surface 16*t*, the side edges of the stencil 16*a* are mutually bonded. Further on the pasted side surface 16*t*, the surfaces of the stencil 16*a* near its side edges are mutually bonded in accordance with a force for winding the stencil 16, minute irregularities of the side edges thereof, and other factors. Alternatively, it is possible to paste both the opposite side surfaces of the stencil roll 16. In such a case, the peeling member 12A can peel and separate the stencil 16*a* off from the stencil roll 16 by using a uniform load applied in the axial direction of the stencil roll 16.

Organic materials such as starch, gum arabic and synthetic rubber are used to paste one or both of the side surfaces of the stencil roll 16.

The starch ($C_6H_{10}O_5$), is usually used as paste because of its properties, i.e. it is insoluble in cold water, but becomes pasty when its micelle is crumbled in hot water. Specifically, when heated in water, starch has amylopectin on its outer core broken and amylose dissolved in water, and becomes pasty. The starch becomes pasty between 60° C. and 80° C. When alkali is applied to the starch and water, it is possible to lower a temperature for gelatinizing the starch. This technique is usually applied to glues for industrial use.

The gum arabic is yielded by acacia, especially, Acacia senegal, of the genus Acacia. When dissolved in water, hemicellulose secreted by branches of the genus Acacia becomes gluey.

Figure 13:
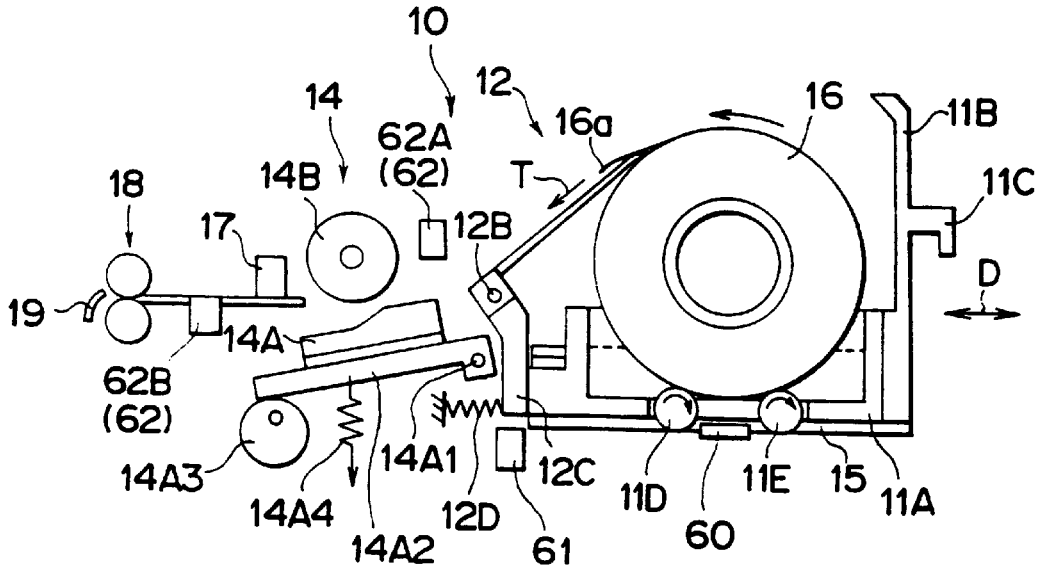
FIG. 13 schematically shows the state of the stencil perforating device immediately after the leading edge of the stencil is paid out from the stencil roll.

The bonding strength of the glue applied to the side surface 16*t* of the stencil roll 16 is determined such that the stencil 16*a* can be reliably peeled off from the stencil roll 16 (as shown in FIG. 13). For this purpose, the bonding strength is decided based on factors such as the kind of material, an amount and concentration of the glue to be applied, drying conditions, and so forth.

The stencil roll 16 whose side surface 16*t* is pasted as described above is placed in the space 11A4 of the stencil roll holder 11A.

The stencil roll 16 is rotated by the stencil roll rotating rollers 11D and 11E in the direction for paying the stencil 16*a* out. Thereafter, the leading edge of the stencil 16*a* is peeled off from the stencil roll 16 by the peeling member 12A. The stencil roll 16 is rotated so as to feed the stencil 16*a* to the predetermined amount, and is then stopped. In such a case, the stencil 16*a* tends to be slack on the stopped stencil roll 16 due to inertia force. However, the stencil 16*a* remains stuck on the stencil roll 16 because of one or both of its pasted side surfaces. This is effective in preventing the stencil 16*a* from being unwound and becoming slack.

Further, the stencil 16*a* can be prevented from being unwound when the stencil roll 16 is being carried, is initially loaded into the stencil perforating device 10, and is re-set therein after some problem or the like.

According to the second embodiment, it is possible to prevent the stencil 16*a* from becoming slack by simply pasting at least one of the side surfaces 16*t* of the stencil roll 16.

Figure 22:
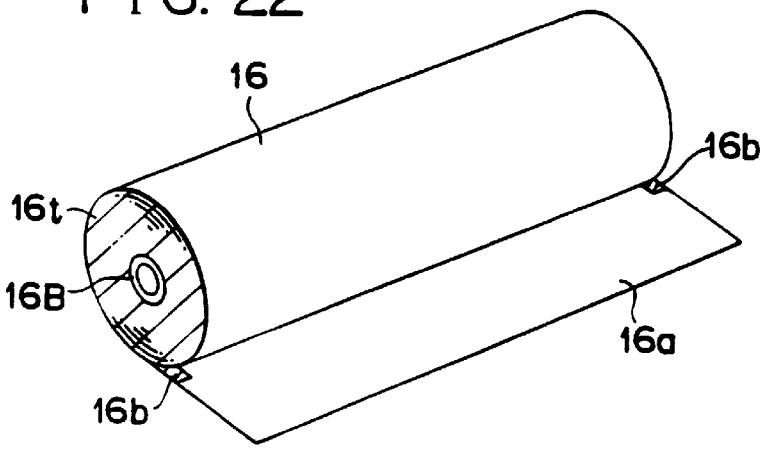
FIG. 22 is a perspective view showing the external appearance of a stencil roll in a first modification of the second embodiment.

A first modification of the second embodiment will be described with reference to FIG. 22. This modification features that the left side surface 16*t* of the stencil roll 16 is entirely pasted except for the leading edge thereof. On the side surface 16*t*, the side edges of the stencil 16*a* are bonded together similarly to the foregoing stencil roll 16. On the pasted side surface 16*t*, the surfaces near the side edges of the wound stencil 16*a* are mutually bonded in accordance with a force for winding the stencil 16, minute irregularities along the side edges thereof, and other factors. The pasted portion begins from positions 16*b* shown in FIG. 22, i.e. the leading edge of a fresh stencil roll 16 is not pasted.

This modification is effective in enabling the leading edge of the stencil 16*a* to be raised due to its flexural strength when it is being paid out. Thus, the leading edge of the stencil 16*a* can precisely confront the peeling member 12A.

Figure 23:
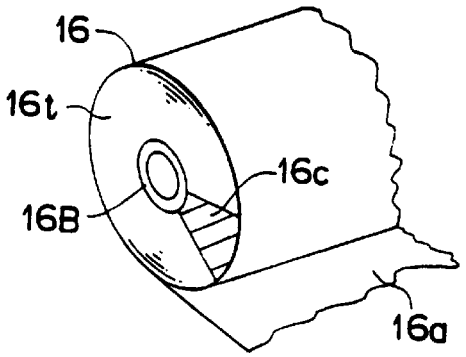
FIG. 23 is a perspective view showing the external appearance of the main part of a stencil roll in a second modification of the second embodiment.

FIG. 23 shows a second modification of the second embodiment. As shown, the stencil roll 16 has at least one side surface 16*t* radially pasted at one portion. The pasted portion is in the shape of a sector 16*c*.

The second modification enables the stencil 16*a* to be paid out by applying a reduced force for rotating the stencil roll 16, compared with the stencil roll 16 whose side surface is entirely pasted. Further, it is possible to reduce an amount of paste.

Figure 24:
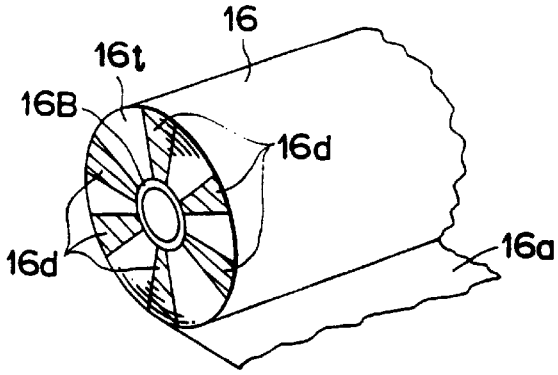
FIG. 24 is a perspective view showing the external appearance of the main part of a stencil roll in a third modification of the second embodiment.
Figure 25:
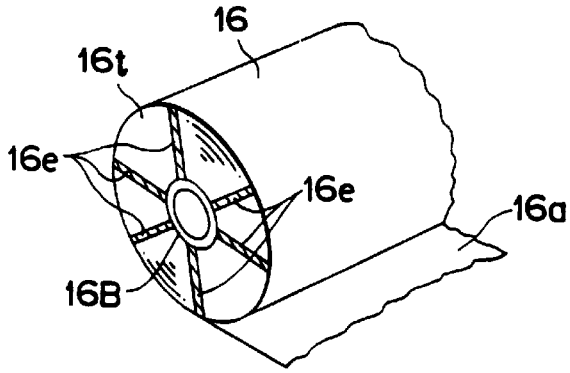
FIG. 25 is a perspective view showing the external appearance of the main part of another example of the stencil roll in the third modification.

In a third modification of the second embodiment, the stencil roll 16 has its side surface 16*t* which is radially pasted at several portions. The pasted portions are in the shape of sectors 16*d* as shown in FIG. 24. This is because the pasted sectors 16*d* are effective in coping with a large inertia force which is generated by a thick stencil roll 16 when it starts rotation or when it is stopped. Alternatively, it is possible to paste the side surface 16*t* of the stencil roll 16 in the shape of radial strips 16*e*, as shown in FIG. 25.

In the foregoing modifications, the stencil roll 16 may be pasted not only on one side surface 16*t* but also on both side surfaces 16*t*. Any of the modifications can be selected depending upon the ease of paying out the stencil 16*a*, an extent of inertia force which is responsible for slackness of the stencil 16*a*, and other factors.

Figure 26:
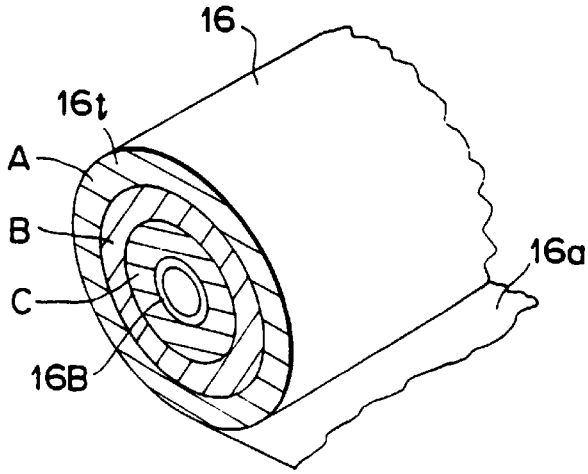
FIG. 26 is a perspective view showing the external appearance of the main part of a stencil roll in a fourth modification of the second embodiment.

FIG. 26 shows a fourth modification of the second embodiment. One side surface 16*t* of the stencil roll 16 is pasted in the shape of concentric areas A, B and C having different colors. Alternatively, the stencil roll 16 may be applied with a colored paste only near the end of the usable area of the stencil roll 16.

This modification enables the user to recognize the remaining amount of the stencil 16*a* and a time to replace the stencil roll 16 by observing the paste colors.

Figure 27:
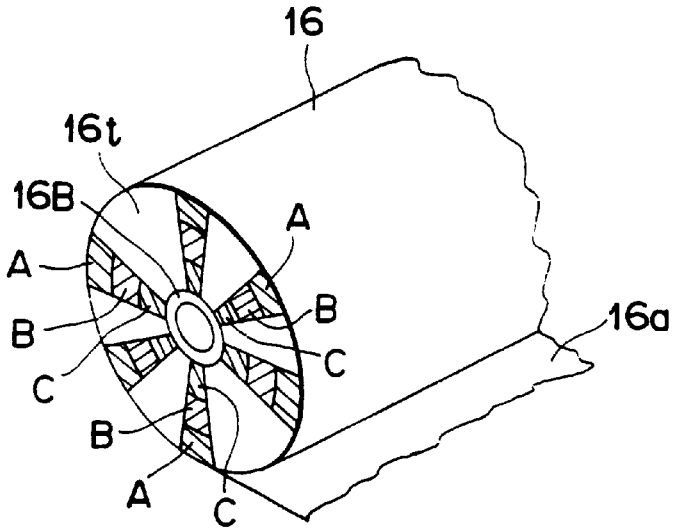
FIG. 27 is a perspective view showing the external appearance of the main part of a stencil roll in another example of the stencil roll in the fourth modification.

With respect to the fourth modification, the colored pastes A, B and C may be radially and sequentially applied in the shape of sectors, as shown in FIG. 27.

In the foregoing modification, it is not always necessary to uniformly apply the pastes, but they may be applied in such a manner as to denote a message or the like.

Figure 28:
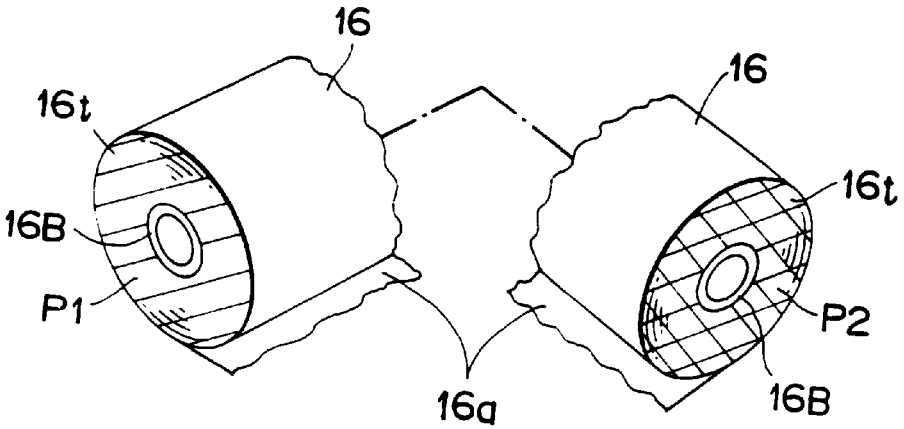
FIG. 28 is a perspective view showing the external appearance of the main part of a stencil roll in a fifth modification of the second embodiment.

In a fifth modification of the second embodiment, the stencil roll 16 has its opposite side surfaces 16*t* entirely applied with different color pastes P1 and P2, respectively, as shown in FIG. 28. In this case, the color pastes serve as identification marks.

The side surfaces 16*t* having the different color pastes facilitate the recognition of the pay-out direction of the leading edge of the stencil 16*a* when the stencil roll 16 is placed in the space 11A4 of the stencil roll holder 11A (shown in FIGS. 2 and 3). Observing the paste colors, the user can easily place the stencil roll 16 in the stencil roll holder 11A. This is effective in preventing the leading edge of the stencil 16*a* from being jammed or from not being paid out from the stencil roll 16.

In this modification, the color pastes may be applied not only entirely but also in the shape of letters denoting "blue", "red", and so on. The identification marks may be helpful for the user to recognize the side surfaces 16*t* of the stencil roll 16. The foregoing samples are given simply as an example, and may be modified as desired.

The fourth and fifth modifications are applicable to a single side surface or both side surfaces of the stencil roll 16, as in the first to third modifications.

Figure 29:
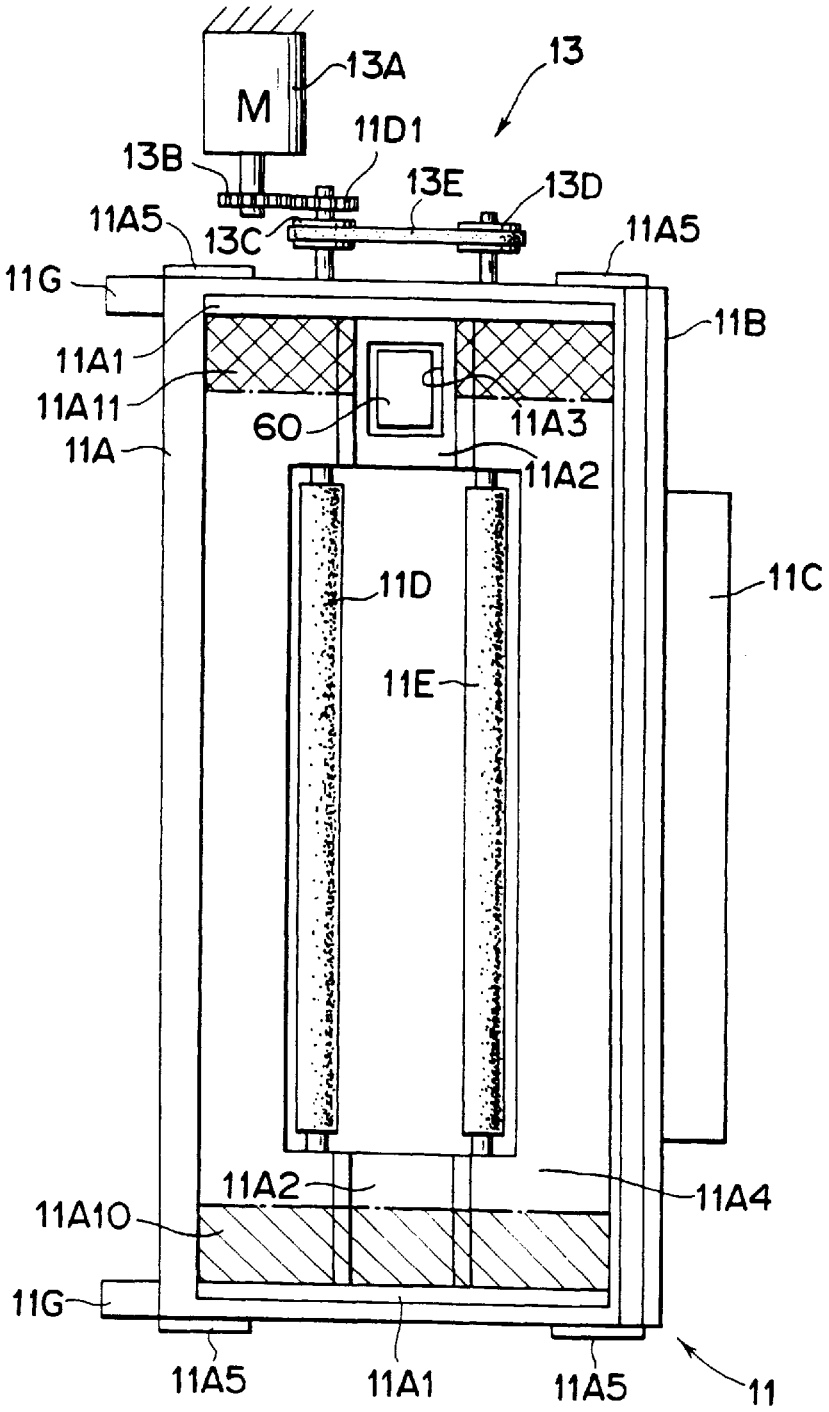
FIG. 29 is a top view of a stencil roll holding unit used in the third modification of the first embodiment.

The stencil roll 16 shown in FIG. 28 is preferably applied to a modified stencil roll holding unit 11 shown in FIG. 29 (i.e. a third modification of the first embodiment). This stencil roll holding unit 11 is substantially identical to that shown in FIG. 3, but differs from it in the following respect. The stencil roll holding unit 11 includes identification marks 11A10 and 11A11 which are applied to the stencil roll holder 11A, and correspond to the identification marks on the side surfaces 16*t* of the stencil roll 16. Specifically, the identification mark 11A10 corresponds to the color paste P1 of the side surface 16*t* while mark 11A11 corresponds to the color paste P2, shown in FIG. 28.

This modification is effective in facilitating the correct loading of the stencil roll 16 in the stencil roll holding unit 11 by matching the identification marks P1 and P2 of the stencil roll 16 with the identification marks 11A10 and 11A11 of the stencil roll holder 11A. Thus, the leading edge of the stencil 16*a* can be easily recognized and reliably paid out. When only one of the side surfaces 16*t* is applied the identification mark, its corresponding identification mark may be simply applied to the stencil roll holder 11A.

Figure 30:
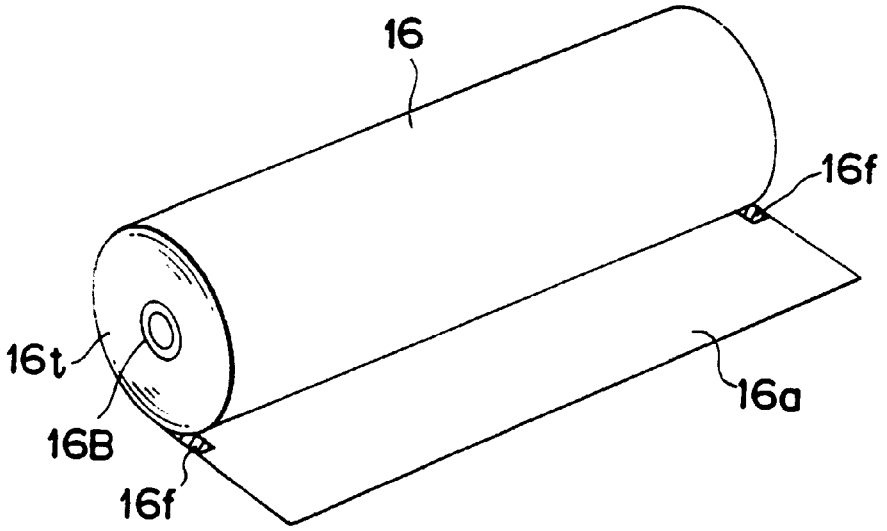
FIG. 30 is a perspective view showing the main part of a stencil roll used in a sixth modification of the second embodiment.

A sixth modification of the second embodiment is shown in FIG. 30. In this case, the stencil roll 16 has its opposite side surfaces 16*t* pasted only at positions 16*f* along the side edges of the stencil 16*a* on the outermost layer of the stencil roll 16, except for the leading edge thereof. Further, in this modification, the stencil roll 16 may have its opposite side surfaces 16*t* pasted only at the side edges of the stencil 16*a* on the outermost layer of the stencil roll 16, except for the leading edge thereof.

Figure 31:
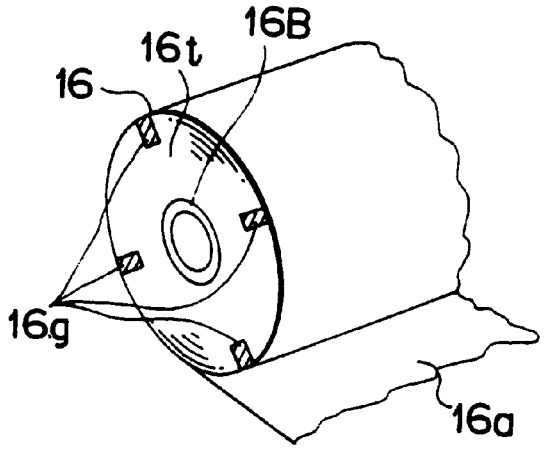
FIG. 31 is a perspective view showing the main part of a stencil roll used in a seventh modification of the second embodiment.

In a seventh modification of the second embodiment shown in FIG. 31, the stencil roll 16 has its side surface 16*t* pasted at several positions 16*g* which are spaced apart from one another and extend toward its peripheral edge.

The sixth and seventh modifications are effective in preventing the stencil 16*a* from becoming loose when a fresh stencil roll 16 is carried or is loaded into the stencil roll holding unit 11. On the other hand, the first to fifth modifications are effective not only in protecting the stencil 16*a* against being unwound during the carrying and initial loading but also during the re-setting of the stencil roll 16 at the time of a fault, etc.

The present invention is applicable not only to the foregoing stencils 16*a* but also to a stencil substantially made only from a thermoplastic resin film, a thermoplastic resin film containing a minute amount of anti-static agent, or a stencil including a thermoplastic resin film covered by one or more overcoating layers on at least one surface thereof. Such a stencil is as thick as 1 $\mu$m to 3 $\mu$m and is offered in the shape of a roll.

The stencil perforating device of the invention is also applicable to a conventional stencil roll having a core projecting at its opposite side edges. The stencil roll holding unit can receive such a stencil roll by modifying the structure for positioning the stencil roll.

The second embodiment is applicable to stencil rolls having stencils wound thereon without using cores. The stencil perforating device can receive such stencil rolls by a simple modification of the stencil roll support.

Needless to say, the stencil rolls 16 referred to in the first and second embodiment and their modifications also may have end marks 16A with the reduced reflection similarly to that shown in FIG. 10.

The stencil roll according to the invention is advantageously applicable to a stencil printer in which the stencil is perforated in accordance with images of the original document using a stencil perforating unit. The stencil roll can be easily handled when it is carried or it is initially set in the stencil perforating unit. In the stencil perforating unit, the stencil can be automatically or semi-automatically paid out from the stencil roll without becoming loose at its leading edge.

What is claimed is:

1. A stencil perforating device comprising:

a stencil roll holding unit for rotatably holding a stencil roll;

wherein said stencil roll holding unit has at least one identification mark which corresponds to at least one identification mark of the stencil roll.

* * * * *